US007255077B2

(12) United States Patent
Simpson et al.

(10) Patent No.: US 7,255,077 B2
(45) Date of Patent: Aug. 14, 2007

(54) CTA PHASER WITH PROPORTIONAL OIL PRESSURE FOR ACTUATION AT ENGINE CONDITION WITH LOW CAM TORSIONALS

(75) Inventors: Roger T. Simpson, Ithaca, NY (US); Franklin R. Smith, Cortland, NY (US); Marty Gardner, Dryden, NY (US)

(73) Assignee: BorgWarner Inc., Auburn Hills, MI (US)

( * ) Notice: Subject to any disclaimer, the term of this patent is extended or adjusted under 35 U.S.C. 154(b) by 90 days.

(21) Appl. No.: 11/286,483

(22) Filed: Nov. 23, 2005

(65) Prior Publication Data

US 2006/0086332 A1 Apr. 27, 2006

Related U.S. Application Data

(63) Continuation-in-part of application No. 10/984,592, filed on Nov. 9, 2004, now Pat. No. 6,997,150.

(60) Provisional application No. 60/520,594, filed on Nov. 17, 2003.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31, 90.48
See application file for complete search history.

(56) References Cited

U.S. PATENT DOCUMENTS

| | | | | |
|---|---|---|---|---|
| 5,107,804 | A | 4/1992 | Becker et al. | 123/90.17 |
| 5,657,725 | A | 8/1997 | Butterfield et al. | 123/90.17 |
| 6,276,321 | B1 | 8/2001 | Lichti et al. | 123/90.17 |
| 6,453,859 | B1 | 9/2002 | Smith et al. | 123/90.17 |
| 6,481,402 | B1 * | 11/2002 | Simpson et al. | 123/90.17 |
| 6,591,799 | B1 | 7/2003 | Hase et al. | 123/90.17 |
| 6,763,791 | B2 | 7/2004 | Gardner et al. | 123/90.17 |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A variable camshaft timing phaser for an internal combustion engine having at least one camshaft comprising a plurality of vanes in chambers defined by a housing and a spool valve. The vanes define an advance and a retard chamber. At least one of the vanes is cam torque actuated (CTA) and at least one of the other vanes is oil pressure actuated (OPA). The spool valve is coupled to the advance and retard chamber defined by the CTA vane and the advance chamber defined by the OPA vane. When the phaser is in the advance position, fluid is routed from the retard chamber defined by the OPA vane to the retard chamber defined the CTA vane. When the phaser is in the retard position, fluid is routed from the retard chamber defined by the CTA vane to the advance chamber defined by the CTA vane.

32 Claims, 19 Drawing Sheets

CTA PHASER WITH PROPORTIONAL OIL PRESSURE FOR ACTUATION AT ENGINE CONDITION WITH LOW CAM TORSIONALS

REFERENCE TO RELATED APPLICATIONS

This application is a continuation-in-part of U.S. application Ser. No. 10/984,592, filed Nov. 9, 2004, entitled "CTA PHASER WITH PROPORTIONAL OIL PRESSURE FOR ACTUATION AT ENGINE CONDITION WITH LOW CAM TORSIONALS" which was disclosed in Provisional Application No. 60/520,594, filed Nov. 17, 2003, entitled "CTA PHASER WITH PROPORTIONAL OIL PRESSURE FOR ACTUATION AT ENGINE CONDITION WITH LOW CAM TORSIONALS." The aforementioned applications are hereby incorporated herein by reference.

BACKGROUND OF THE INVENTION

1. Field of the Invention

The invention pertains to the field of variable cam timing systems. More particularly, the invention pertains to an apparatus for allowing actuation of a phaser during low cam torsionals.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a housing with one or more vanes, mounted to the end of the camshaft, surrounded by a housing with the vane chambers into which the vanes fit. It is possible to have the vanes mounted to the housing, and the chambers in the housing, as well. The housing's outer circumference forms the sprocket, pulley or gear accepting drive force through a chain, belt or gears, usually from the camshaft, or possibly from another camshaft in a multiple-cam engine.

Two types of phasers are Cam Torque Actuated (CTA) and Oil Pressure Actuated (OPA). In OPA or torsion assist (TA) phasers, the engine oil pressure is applied to one side of the vane or the other, in the retard or advance chamber, to move the vane. Motion of the vane due to forward torque effects is permitted.

In a CTA phaser, the variable cam timing system uses torque reversals in the camshaft caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage but does not use engine oil pressure to move the phaser. CTA phasers have shown that they provide fast response and low oil usage, reducing fuel consumption and emissions. However, in some engines, i.e. 4 cylinder, the torsional energy from the camshaft is not sufficient to actuate the phaser over the entire speed range of the engine, especially the speed range where the rpm is high.

FIG. 7 shows a graph of actuation rate versus rpm. When the revolutions per minute (rpm) is low, cam torsional energy is high. When rpm is high, cam torsional energy drops off. The actuation rate for an oil pressure actuated (OPA) or torsion assist (TA) phaser is shown by the dashed line. Since oil pressure is low at low rpm, the actuation rate is also low. As the rpm increases, the oil pressure increases and the actuation rate of the OPA or TA phaser also increases. The solid line shows the actuation rate of the cam torque actuated (CTA) phaser. The CTA phaser is actuated by torsional energy, which is high at low rpm and low and higher rpm.

Numerous strategies have been used to solve the problem of low cam torsional energy at high rpm or high engine speeds. For example, if the position of the cam phaser was to full retard during the periods of low torsional energy, the friction of the cam drive may be used to pull the phaser back to the full retard position. Another strategy is to add a bias spring to help move and hold the phaser to a full advance position during periods of low torsional energy. Other examples are shown in U.S. Pat. Nos. 6,276,321, 6,591,799, 5,657,725, and 6,453,859.

U.S. Pat. No. 6,276,321 uses a spring attached to a cover plate to move the rotor to an advanced or retard position to enable a locking pin to slide into place during low engine speeds and oil pressure.

U.S. Pat. No. 6,591,799 discloses a valve timing control device that includes a biasing means for biasing the camshaft in an advanced direction, where the biasing force is approximately equal to or smaller than a peak value of frictional torque produced between a cam and a tappet.

U.S. Pat. No. 5,657,725 discloses a CTA phaser that supplies full pressure to an ancillary vane that provides bias to the phaser based on the pressure of the oil pump. The oil pressure bias uses an open pressure port and lacks proportional control at high engine speeds.

U.S. Pat. No. 6,453,859 discloses a single spool valve controlling a phaser having both a CTA and two check valve torsional assist (TA) properties. A valve switch function is used to switch from CTA to TA during periods of low torsional energy.

SUMMARY OF THE INVENTION

A variable camshaft timing phaser for an internal combustion engine has at least one camshaft comprising a plurality of vanes in chambers defined by a housing and a spool valve. The vanes define an advance and a retard chamber. At least one of the vanes is cam torque actuated (CTA) and at least one , of the other vanes is oil pressure actuated (OPA) or torsion assist (TA). The spool valve is coupled to the advance and retard chamber defined by the CTA vane and the advance chamber defined by the OPA vane. When the phaser is in the advance position, fluid is routed from the retard chamber defined by the OPA vane to the retard chamber defined the CTA vane. When the phaser is in the retard position, fluid is routed from the retard chamber defined by the CTA vane to the advance chamber defined by the CTA vane.

The phaser further comprises a locking pin located in one of the vanes. The locking pin is in the locked position when the locking pin is received in the receiving hole in the housing. The receiving hole is located at the fully advance stop position or the fully retard stop position, depending on whether the phaser is exhaust or intake.

DETAILED DESCRIPTION OF THE INVENTION

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

Figure 8B:
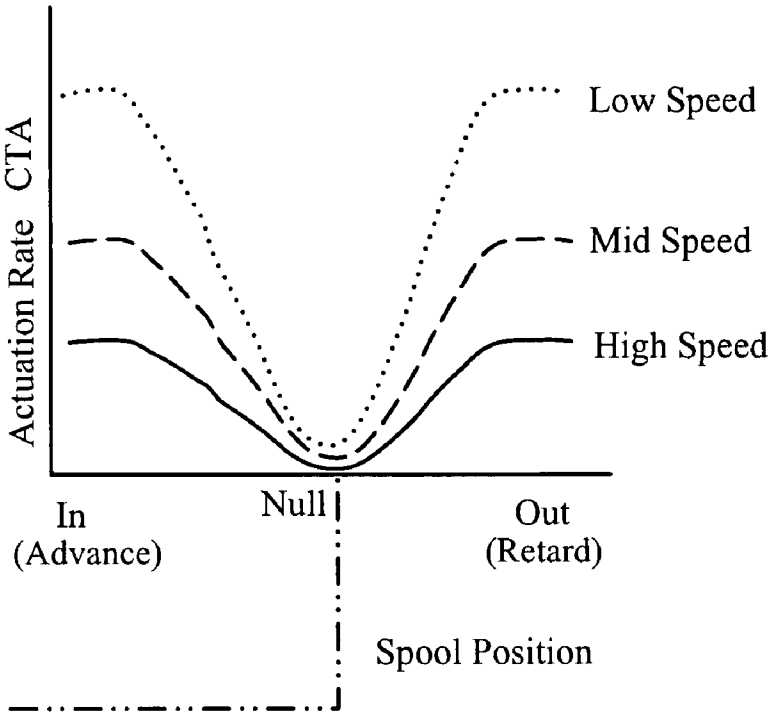
FIG. 8*b* shows a graph of actuation rate of an CTA phaser versus spool position at various speeds.
Figure 8A:
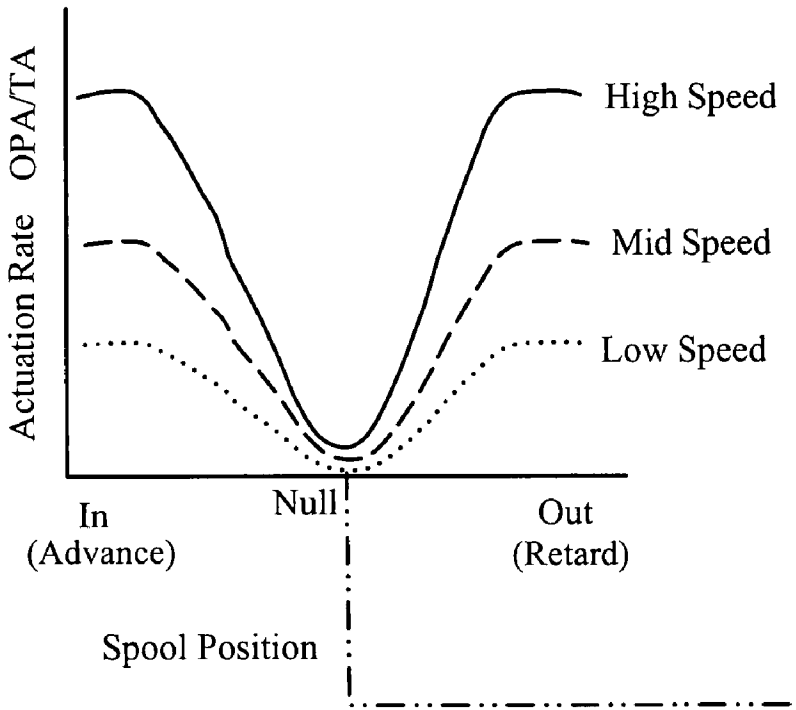
FIG. 8*a* shows a graph of actuation rate of an OPA/TA phaser versus spool position at various speeds.

FIGS. 8*a* and 8*b* show graphs of actuation rate versus spool position in OPA/TA phasers and in CTA phasers. As shown in FIG. 8*a*, the actuation rate is highest at high speeds, indicated by the solid line, and when the spool is in the inner position and the outer position for the OPA/TA phasers. The actuation rate is lowest at low speed, indicated by the dotted line. At mid speed, indicated by the dashed line, the actuation rate is between the actuation rates of the phaser at high speeds and low speeds. FIG. 8*b* shows the highest actuation rates for the CTA phaser, when the phaser is operating at low speeds, indicated by the dotted line, and the spool is in the inner and the outer positions. The actuation rate of the CTA phaser at high speeds, indicated by the solid line, is low. At mid speed, indicated by the dashed line, the actuation rate is between the actuation rates of the phaser at high speeds and low speeds. As shown by comparing the graphs, the null position is the same in both the OPA/TA phasers and the CTA phaser. Furthermore, the actuation of the CTA phaser at high speed may be aided by actuating the OPA or TA phaser at high speeds, such that the sum of the two actuations at a give speed results in satisfactory engine performance, even in a four cylinder engine.

Referring to FIGS. 1-6, a sprocket 10 is connected to the housing 24. The rotor 12 has a diametrically opposed pair of radially outward projecting vanes 22, which fit into the housing 24. The rotor 12 houses the spool 104 and locking pin 300. One of the vanes 22 of the rotor 12 contains locking pin 300. Locking pin 300 is received by a receiving hole 151 located in the housing 24. Connected to the rotor 12 is a reed check valve plate 14, containing at least two check valves 122 and 124. A cover 18 and spacer 16 are attached to the reed check valve plate 14.

Figure 1:
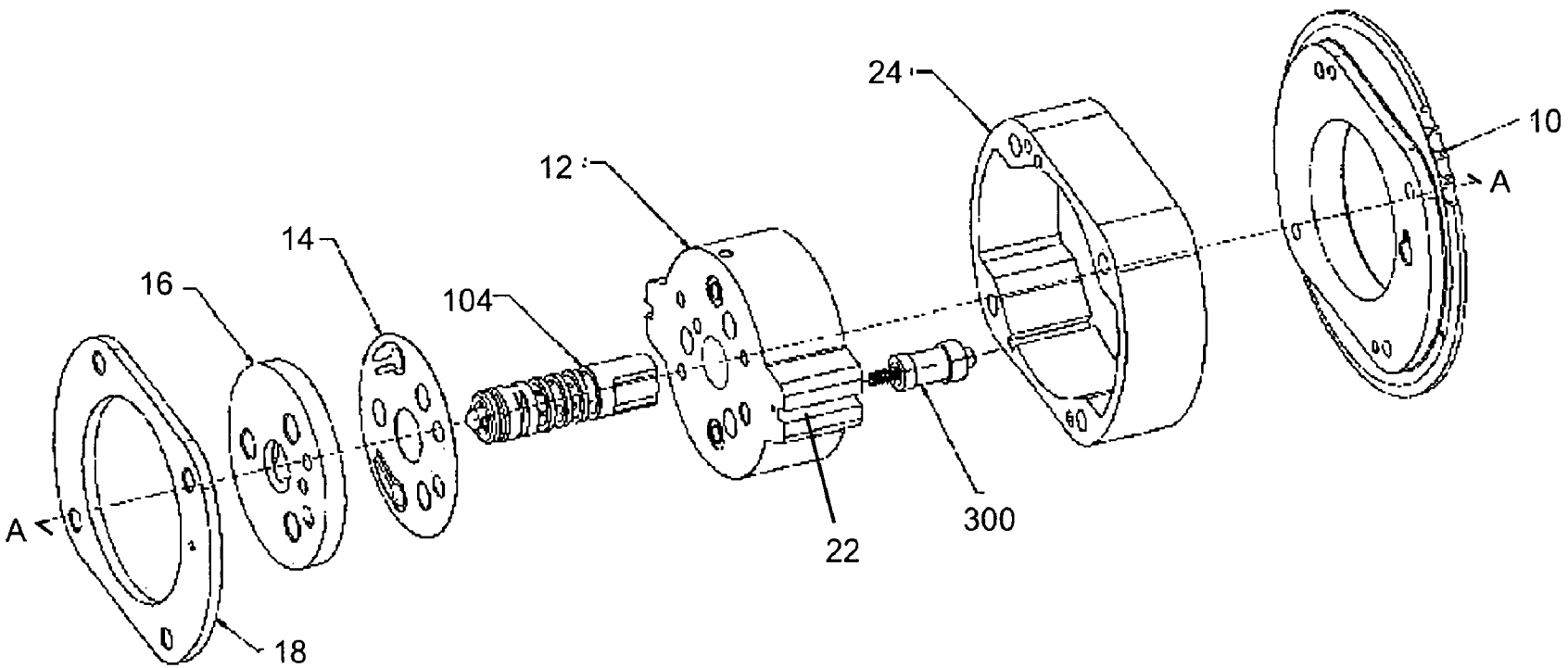
FIG. 1 shows a perspective view of the present invention.
Figure 2:
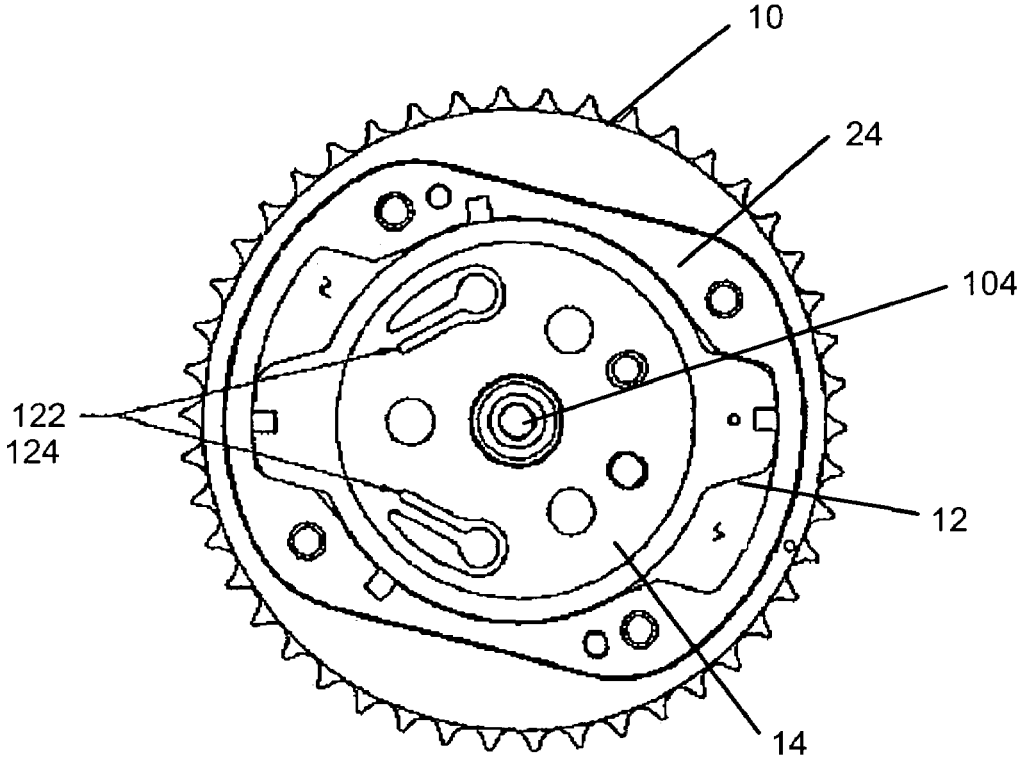
FIG. 2 shows an end view of FIG. 1 with the cover plate and spacer plate removed.
Figure 3:
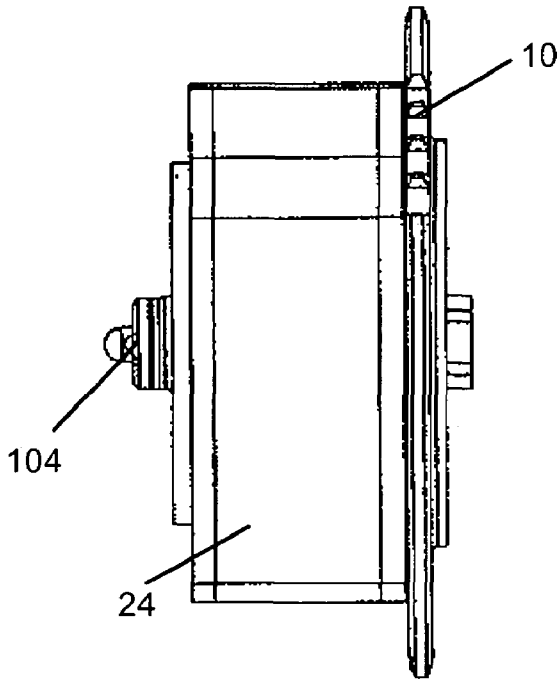
FIG. 3 shows a side view of FIG. 1 along line A-A.
Figure 4:
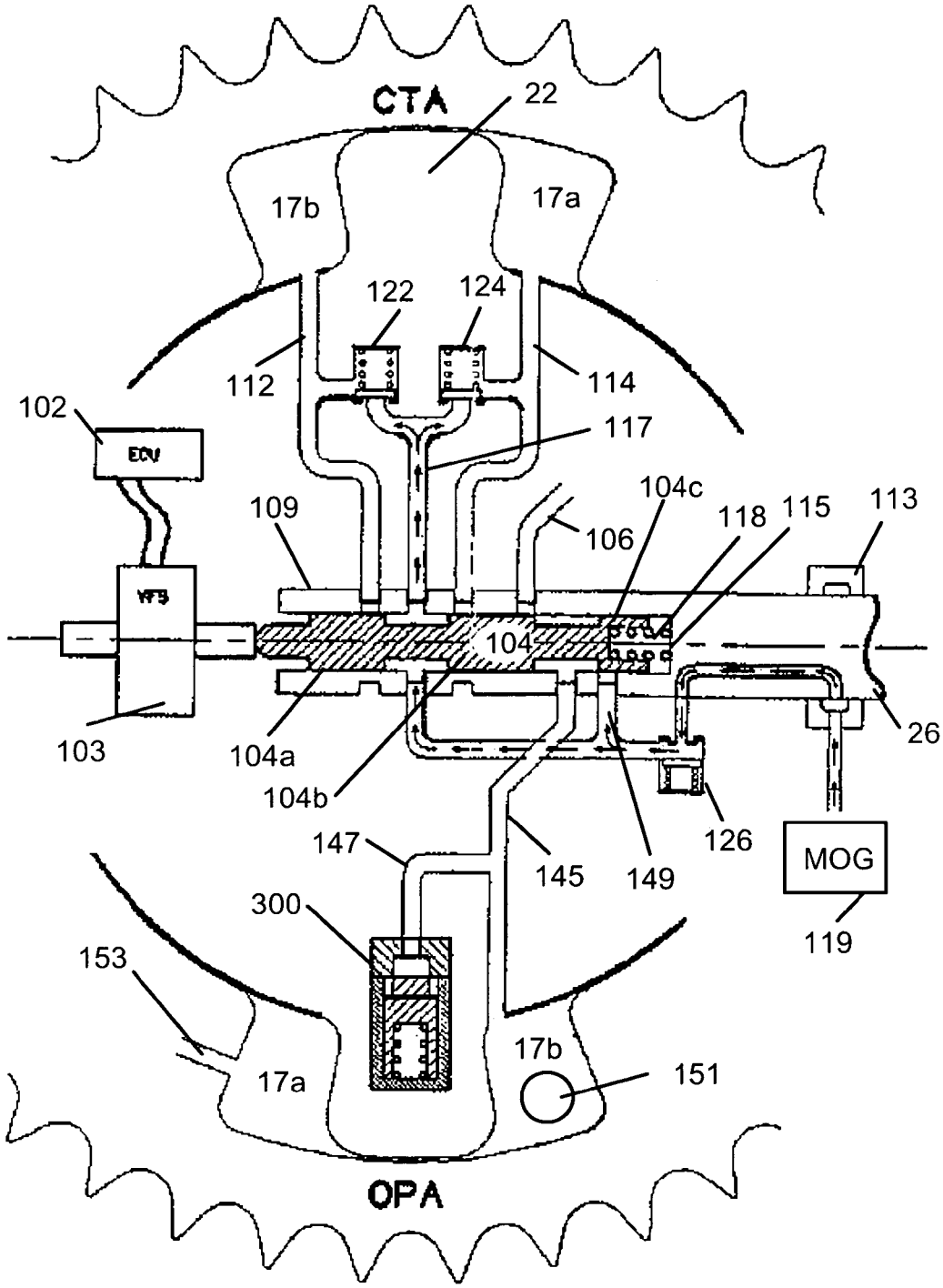
FIG. 4 shows a schematic of a first embodiment of the present invention in null position.
Figure 5:
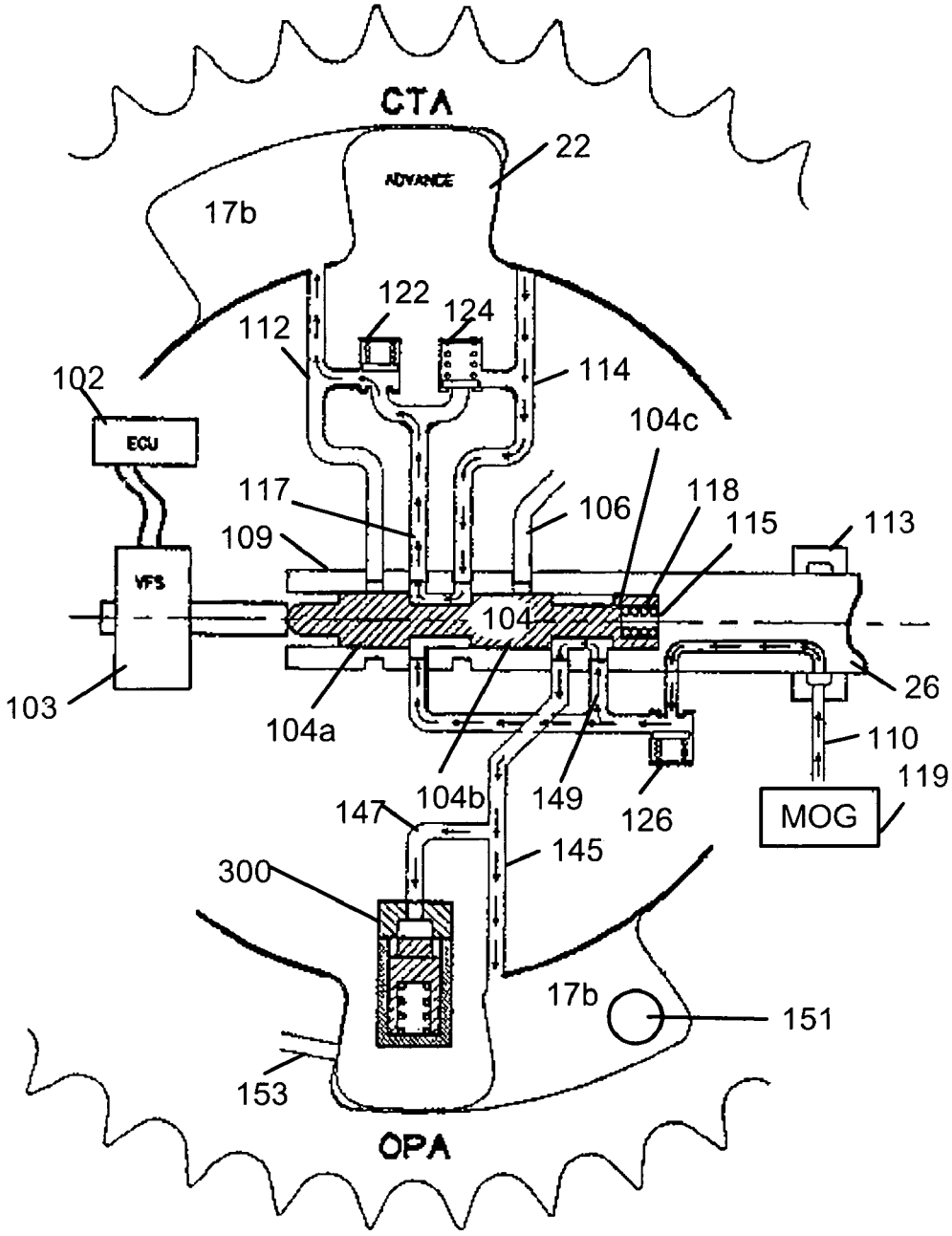
FIG. 5 shows a schematic of a first embodiment of the present invention in advance position.
Figure 6:
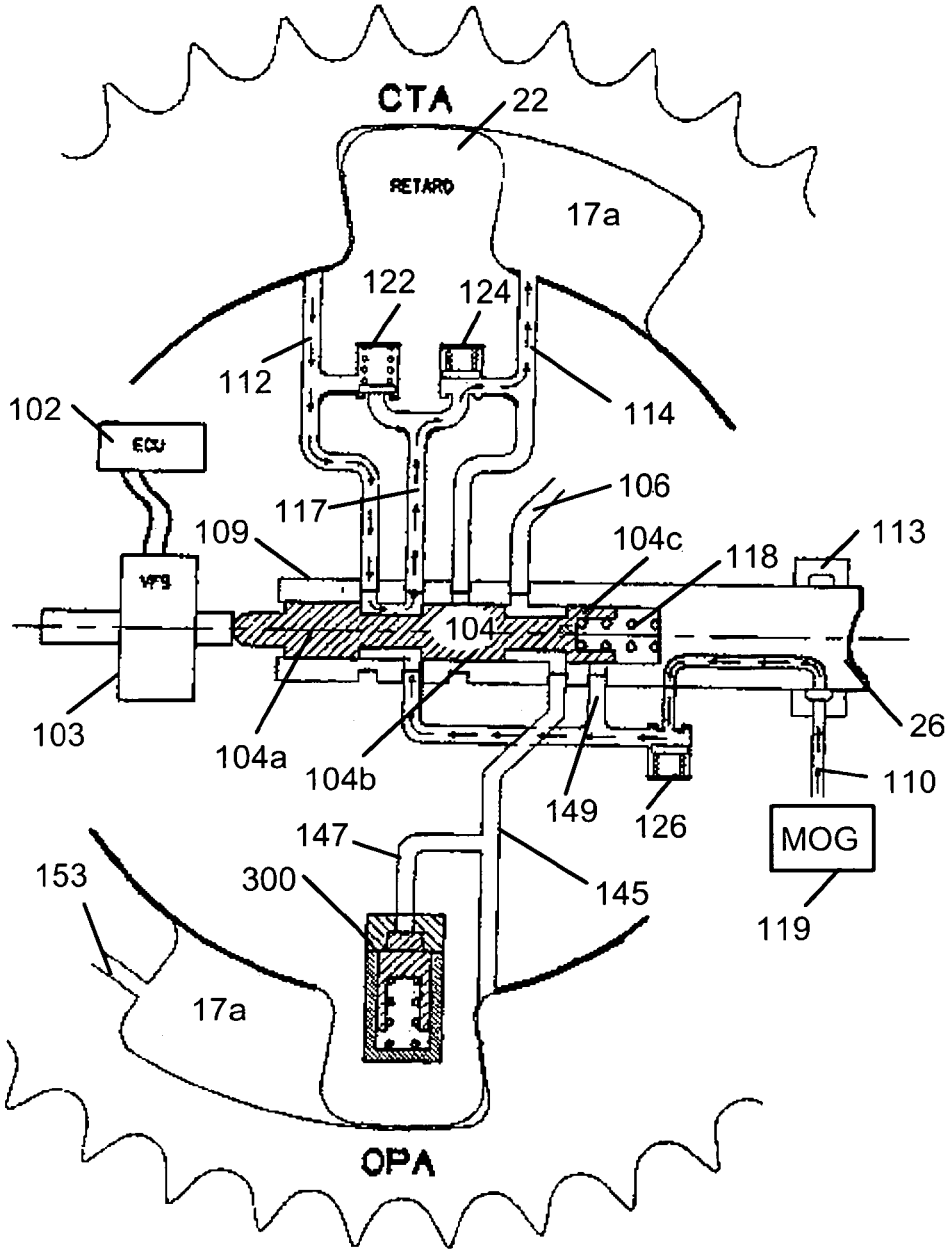
FIG. 6 shows a schematic of a first embodiment of the present invention in retard position.
Figure 7:
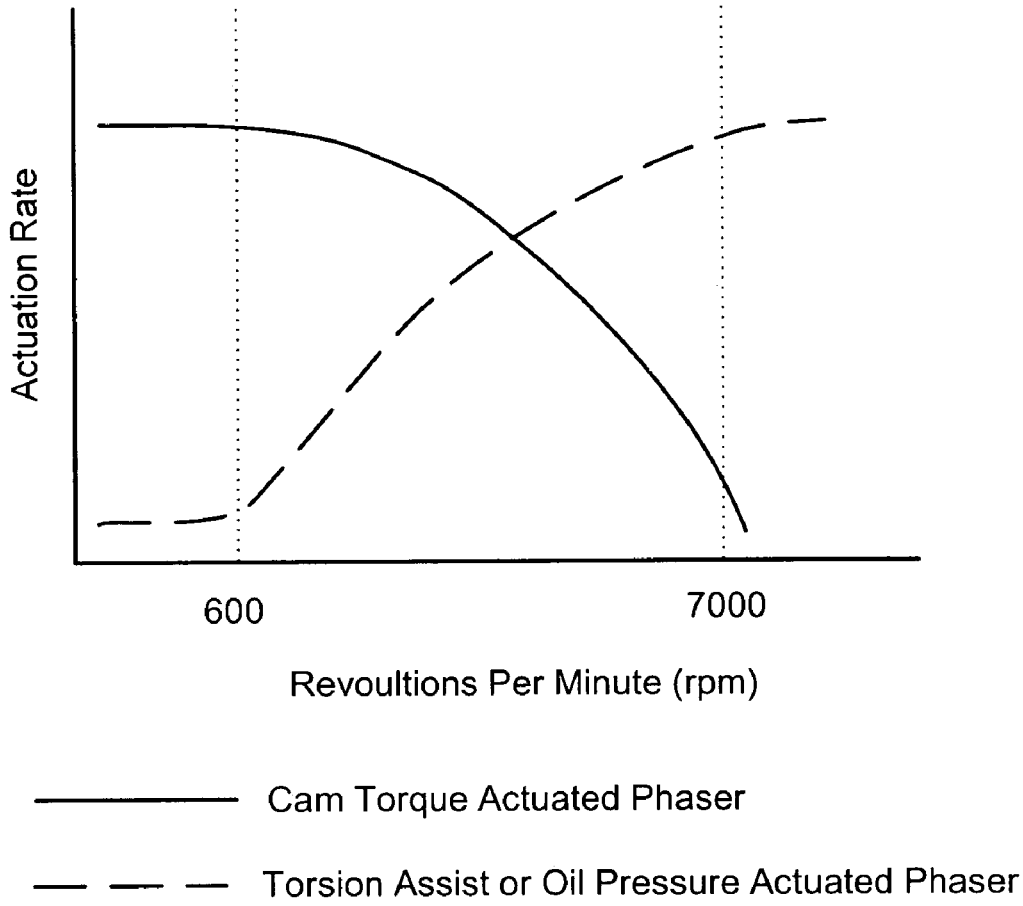
FIG. 7 shows a graph of actuation rate versus revolutions per minute (rpm) for an oil pressure actuated/torsion assist phaser and a cam torque actuated phaser.

FIGS. 4-6 show the null, advance and retard positions of the phaser respectively. The phaser operating fluid, illustratively in the form of engine lubricating oil flows into the advanced chambers 17*a* and the retard chambers 17*b*. The engine lubricating oil is introduced into the phaser by way of a common inlet line 110 connected to the main oil gallery 119. Inlet line 110 enters the phaser through bearing 113 of the camshaft 26. The common inlet line 110 contains check valve 126, which may or may not be present to prevent any back flow of oil into the main oil gallery 119. If the check valve 126 is present, then the vane is torsion assist (TA) and if the check valve 126 is not present, the vane is oil pressure actuated (OPA). Inlet line 110 branches into two paths, both of which terminate as they enter the spool valve 109. One branch of inlet line 110 leads to supply line 117 and the other branch, line 149, leads to line 145. Line 145 branches into two paths, one of which supplies oil to chamber 17*b*, and the other line 147 which leads to locking pin 300.

Locking pin 300 locks only when it is received in receiving hole 151 in chamber 17*b*. The receiving hole 151 may be located at the full advanced stop, the fully retarded stop, or slightly away from the stop, depending on whether the cam phaser is intake or exhaust. Intake cam phasers are usually locked in the full retard position when the engine is started and exhaust cam phasers are usually locked in the full advance position when the engine is started. The locking pin 300 is slidably located in a radial bore in the rotor comprising a body having a diameter adapted to a fluid-tight fit in the radial bore. The inner end of the locking pin 300 is adapted to fit in receiving hole 151 defined by the housing 24. The locking pin 300 is radially movable in the bore from a locked position in which the inner end fits into the receiving hole 151 defined by the housing 24 to an unlocked position in which the inner end does not engage the receiving hole 151 defined by the housing 24.

The spool valve 109 is made up of a spool 104 and a cylindrical member 115. The spool 104 is slidable back and forth and includes spool lands 104*a*, 104*b*, and 104*c*, which fit snugly within cylindrical member 115. The spool lands 104*a*, 104*b*, and 104*c* are preferably cylindrical lands and preferably have three positions, described in more detail below. The position of the spool within the cylindrical member 115 is influenced by spring 118, which resiliently urges the spool to the left (as shown in FIGS. 4-6). A variable force solenoid (VFS) 103 urges the spool to the right in response to control signals from the engine control unit (ECU) 102.

To maintain a phase angle, the spool 104 is positioned at null, as shown in FIG. 4, cam torsional energy, oil pressure, and friction torque have to be balanced. Makeup oil from the main oil gallery 119 fills both chambers 17*a* and 17*b*. When the spool 104 is in the null position, spool lands 104*a* and 104*b* block lines 112, 114, and exhaust port 106. Line 117 remains unblocked and is the source of the makeup oil. Supply line 117 branches into two lines, each connecting to lines 112 and 114. The branches of line 117 contain check valves 122 and 124 to prevent back flow of oil into supply line 117. Since lines 112, 114, and exhaust port 106 are blocked by the spool 104, pressure is maintained in chambers 17*a* and 17*b*. Spool land 104*c* partially blocks line 149. The partial blockage of line 149 allows enough oil to enter line 145 and 147 to unlock the locking pin from the receiving hole to move the vane and then maintain vane 22 with locking pin 300 in the null position. The locking pins tip drags along the inside of the phaser since receiving hole 151 is not present.

FIG. 5 shows the phaser in the advance position. To move to the advance position the spool 104 is moved to the right, compressing spring 118 within the cylindrical member 115. A small amount of oil is supplied to the locking pin 300 to unlock the pin 300 from the receiving hole 151 if the prior position was retard. Oil pressure from the main oil gallery aids in commanding the phaser to the advanced position in addition to the oil pressure used to push the vane on the oil pressure actuated side containing the locking pin 300. Oil flows from the main oil gallery 119 through common inlet line 110 into line 145 and line 117. The oil in line 117 flows into line 112, through check valve 122 filling chamber 17*b*, aiding the vane, in addition to what little cam torsional energy is present, to move to the advance position. In moving vane 22, any oil in chamber 17*a* is forced out into line 114 which leads back into line 117. The oil in line 149 leads to lines 147 and 145, filling chamber 17*b* and aiding the vane into moving in the direction shown, in addition to cam torsional energy already present. Any oil that was present in chamber 17*a* is forced out vent 153. The locking pin 300 remains in the unlocked position since the receiving hole 151 is not present when the vane 22 is in the advance position. By using the oil pressure aid when moving the phaser to the advance position, the phaser may be used at both high rpm, when little cam torsional energy is present, and low rpm, when oil pressure is low.

FIG. 6 shows the phaser in the retard position. The phaser may be in this position during periods of low torsional energy because the friction of the cam bearing is trying to return the phaser to the retard position during low and high speeds. During low engine speeds, the spool 104 is moved to the left, against the force of the variable force solenoid 103 and cam torsional energy moves the phaser to the retard position. Oil pressure plays a minimal role in aiding the moving of the vane to the retard position and is present for makeup oil. The oil in line 117 flows into line 14 through check valve 124, filling chamber 17*a*, aiding in moving the vane to the retard position. Any oil in chamber 17*b* is forced out into line 112, which leads back into line 117. Spool land 104*c* blocks line 149, preventing any oil from reaching the locking pin 300. Oil that was present in chamber 17*b* is received by line 145, which leads to vent 106. In the retard position, the locking pin 300 is received by hole 151.

At high speeds, friction of the cam bearing provides a significant drag that aids in moving the phaser to a retard position. Locking pin 300 is received by hole 151 and remains in the locked position.

It should be noted that check valve 126 is shown in FIGS. 4 through 6. By adding the check valve to line 110, the vane with the lock pin is torsion assisted (TA). If the check valve is not present, the vane with the lock pin is oil pressure actuated (OPA).

Figure 9:
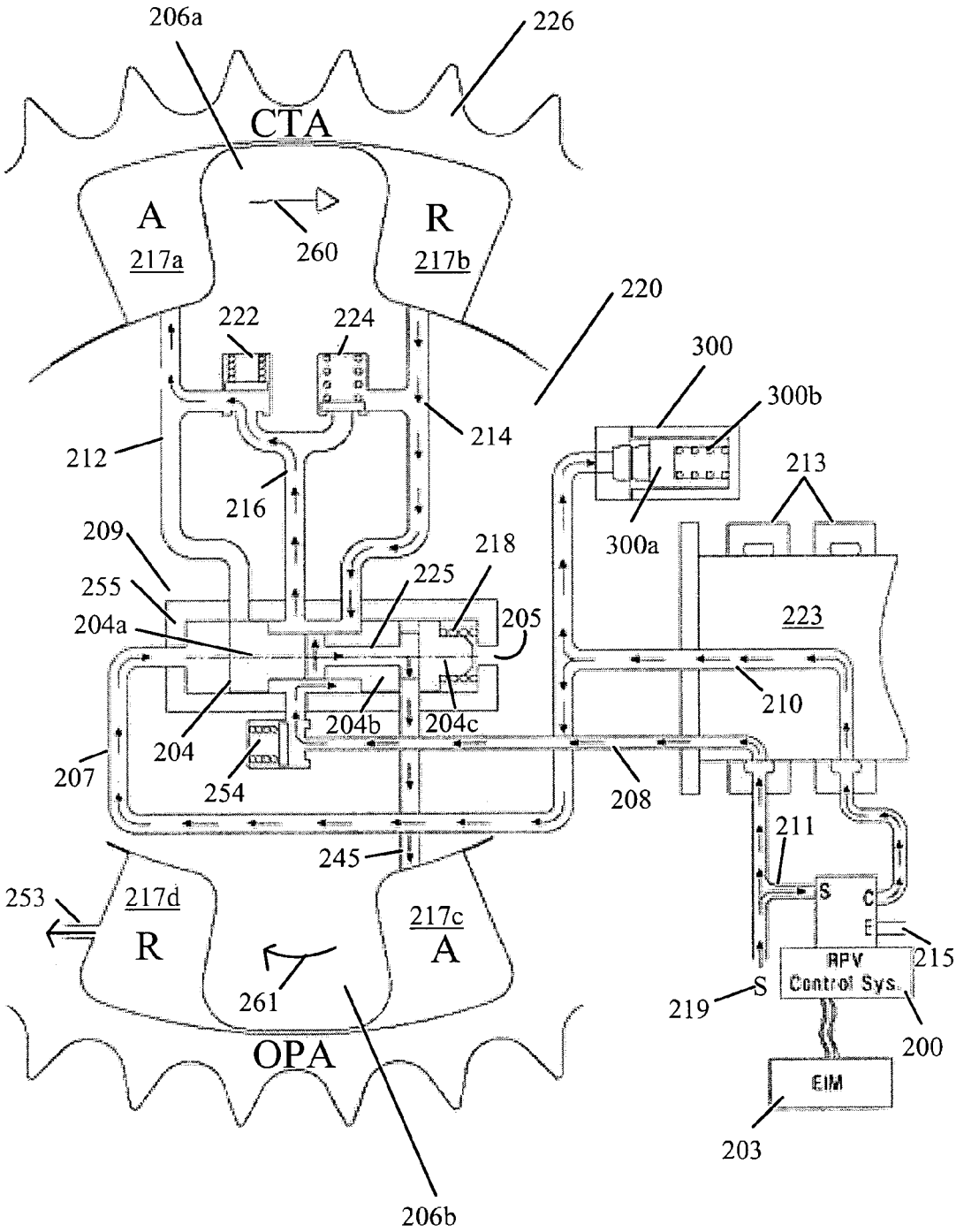
FIG. 9 shows a schematic of the second embodiment of the present invention moving towards the advance position.
Figure 10:
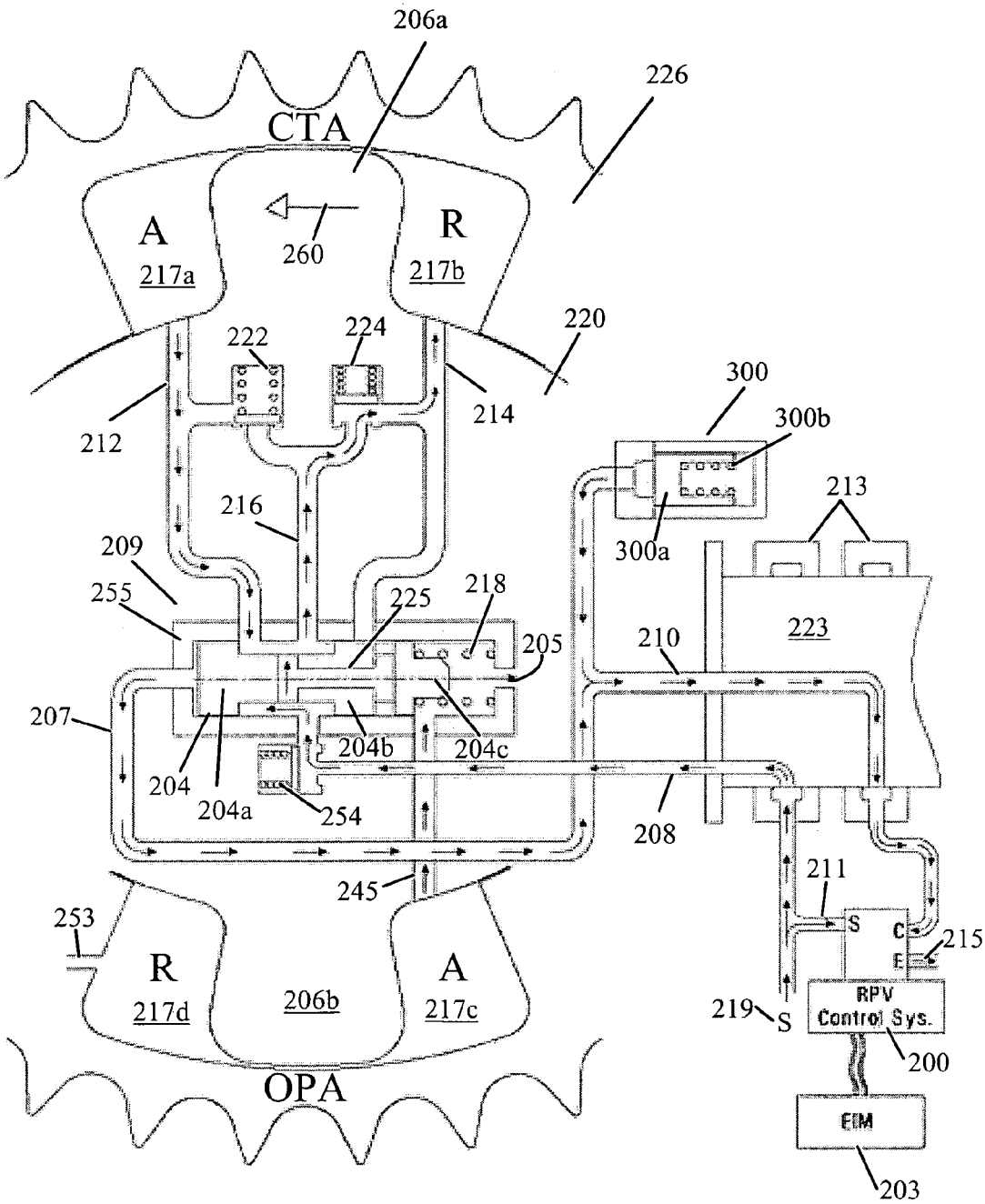
FIG. 10 shows a schematic of the second embodiment of the present invention moving towards the retard position.
Figure 11:
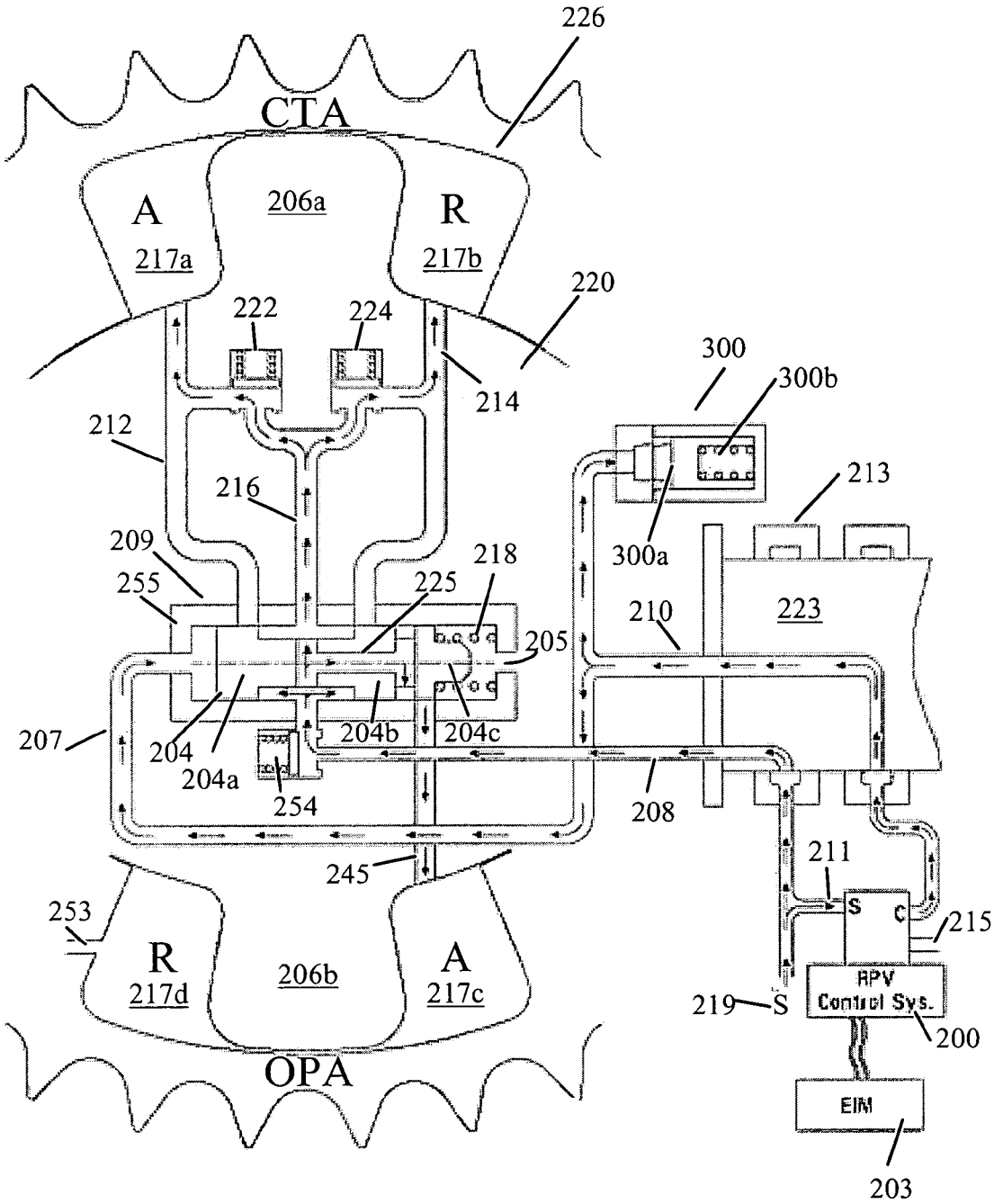
FIG. 11 shows a schematic of the second embodiment of the present invention in the null position.

FIGS. 9 through 11 shows a phaser of a second embodiment. FIG. 9 shows the phaser moving towards the advance position. FIG. 10 shows the phaser moving towards the retard position. FIG. 11 shows the phaser in the null position.

As stated earlier, in reference to FIG. 8, CTA phasers have a low actuation rate at high speeds. However, OPA and TA phasers have a high actuation rate at high speeds. By using a phaser with both CTA and OPA or TA portions, the phaser has a high actuation rate at both high and low speeds, resulting in satisfactory engine performance.

The housing 226 of the phaser has an outer circumference for accepting drive force. The rotor 220 is connected to the camshaft and is coaxially located within the housing 226. The rotor 220 has a first vane 206*a*, which is CTA and a second vane 206*b*, which is OPA, with the CTA vane 206*a* separating a first chamber formed between the housing 226 and the rotor 220 into the CTA advance chamber 217*a* and CTA retard chamber 217*b*, and the OPA vane 206*b* separating a second chamber formed between the housing 226 and the rotor 220 into the OPA advance chamber 217*c* and the OPA retard chamber 217*d*. The CTA and OPA vanes 206*a*, 206*b* are capable of rotation to shift the relative angular position of the housing 226 and the rotor 220.

The spool valve 209 includes a spool 204 with cylindrical lands 204*a*, 204*b*, and 204*c* slidably received in a sleeve 255 in the rotor 220. The spool valve has a centrally located passage 225 that extends to between lands 204*a* and 204*b* and between lands 204*b* and 204*c*. The sleeve 255 has a first end which receives line 207 and a second end which has an opening or a vent 205 that leads to atmosphere. The position of the spool 204 is influenced by spring 218 and a regulated pressure valve control system 200, which is controlled by the ECU 202. The regulated pressure valve control system is also disclosed in a provisional application No. 60/676,771 entitled, "TIMING PHASER CONTROL SYSTEM," filed on May 2, 2005 and is hereby incorporated by reference. The position of the spool 204 controls the motion, (e.g. to move towards the advance position or the retard position) of the phaser.

In this embodiment, the regulated pressure valve control system (RPCS) 200 is located remotely from the phaser in the cylinder head or in the cam bearing cap 223 as shown, and receives fluid from supply through line 211 via line 208. The RPCS valve 200 also has an exhaust port E leading to line 215 and a control port C leading to line 210 through the cam bearing cap 223. The RPCS valve 200 regulates the control pressure from 0 to 1 bar. The control pressure is proportional to the current of the valve. The current of the valve ranges from about 0 to 1 amp. The control pressure crosses the cam bearing 213 and the pressure creates a force on the first end of the spool valve through line 207. By having the control pressure pass across the cam bearing cap interface 223, the leakage between the control fluid and the supply fluid is minimized by the tight cam bearing clearances and/or the cam bearing seals. Furthermore, by using the regulated pressure valve control system, the overall axial package of the phaser is reduced. The RPCS 200 is limited by its dependency on oil pressure and if the operating or supply pressure is lower than 1 bar, the spool travel may be limited and may limit phaser performance.

Locking pin 300 is slidably located in a radial bore in the rotor 220 comprising a body 300*a* having a diameter adapted for a fluid-tight fit in the radial bore. The locking pin 300 is biased to an unlocked position when the pressure of the fluid from line 207 is greater than the force of spring 300*b*. The locking pin is locked when the pressure of the fluid in line 207 is less than the force of spring 300*b* biasing the body 300*a* of the locking pin.

Torque reversals in the camshaft caused by the forces of opening and closing engine valves move the cam torque actuated (CTA) vane 206*a* or a first vane. The CTA advance and retard chambers 217*a*, 217*b* are arranged to resist positive and negative torque pulses in the camshaft and are alternatively pressurized by the cam torque. The control valve or spool valve 209 in the CTA system allows the CTA vane 206*a* in the phaser to move, by permitting fluid flow from the advance chamber 217*a* to the retard chamber 217*b* or vice versa, depending on the desired direction of movement, as shown in FIGS. 9 and 10. Positive cam torsionals are used to move the phaser towards the retard position, as shown in FIG. 10. Negative cam torsionals move the phaser towards the advance position, as shown in FIG. 9.

The other portion of the phaser of the second embodiment is oil pressure actuated (OPA). Line 245 from the spool valve 209 provides or exhausts fluid to or from the OPA advance chamber 217*c*. If the OPA vane 206*b* is moved, as shown in FIG. 9 in direction indicated by arrow 261, fluid in the OPA retard chamber 217*d* exhausts or vents through line 253 to sump.

In moving towards the retard position, as shown in FIG. 10, the force of the control pressure from the RPCS valve 200 in line 207 was reduced and the spool 204 was moved to the left in the figure by spring 218, until the force of spring 218 balanced the force of the control pressure of the RPCS 200. Plus, the force of the pressure of fluid in line 207 is not greater than the spring 300*b* in the locking pin 300, and the pin is moved to a locked position. In the position shown, the movement of the spool 204 forced fluid in the sleeve 255 to exit through line 207 and to line 210 leading to the control port C of the RPCS valve 200. From the control port C of the RPCS, the fluid exhausts through the exhaust port to line 215. Spool land 204*b* blocks line 214, lines 212 and 216 are open, and the CTA vane 206*a* can move towards the retard position. Any fluid present in central passage 225 of the spool exits into line 216. Camshaft torque pressurizes the CTA retard chamber 217*b*, causing fluid in the CTA advance chamber 217*a* to move into the CTA retard chamber 217*b* and the CTA vane 206*a* to move in the direction indicated by arrow 260. Fluid exits the CTA advance chamber 217*a* through line 212 to the spool valve 209 between spool lands 204*a* and 204*b* and recirculates back to central line 216, line 214, and the CTA retard chamber 217*b*. As stated earlier, positive cam torsionals help move the vane 206*a*.

At the same time, fluid exits the OPA advance chamber 217*c* into line 245 and the spool valve 209. From the spool valve 209, fluid exits to sump through vent 205.

Makeup oil is supplied to the phaser from supply 219 to make up for leakage and enters line 208 and moves through inlet check valve 254 to the spool valve 209. From the spool valve 209, fluid enters line 216 and through either of the check valves 222, 224, depending on which is open to the CTA advance or retard chambers 217*a*, 217*b*.

In moving towards the advance position, as shown in FIG. 9, the force of the control pressure from the RPCS valve in line 207 was increased and the spool 304 was moved to the right by spring 218, until the force of the spring 218 balanced the force of the control pressure of the RPCS. The force of the pressure of fluid in line 207 and from line 210 is greater than the spring 300*b* in the locking pin 300, and the pin is moved to an unlocked position. In the position shown, the movement of the spool 204 forced fluid in the sleeve 255 to exit through vent 205. Spool land 204*a* blocks line 212, lines 214 and 216 are open, and the CTA vane 206*a* can move towards the advance position. Camshaft torque pressurizes the CTA advance chamber 217*a*, causing fluid in the CTA retard chamber 217*b* to move into the CTA advance chamber 217*a* and the CTA vane 206*a* to move in the direction indicated by arrow 260. Fluid exits the CTA advance chamber 217*a* through line 214 to the spool valve 209 between spool lands 204*a* and 204*b*, and recirculates back to line 216, line 212, and the CTA advance chamber 217*a*. As stated earlier, negative cam torsionals help move the CTA vane 206*a*.

Makeup oil is supplied to the phaser from supply 219 to make up for leakage and enters line 208 and moves through inlet check valve 254 to the spool valve 209. From the spool valve 209, fluid enters line 216 and through either of the check valves 222, 224, depending on which is open to the CTA advance or retard chambers. The makeup oil in the spool valve is also directed through the central passage 225 to line 245, which supplies the OPA advance chamber 217*c*. The fluid in the OPA advance chamber 217*c* helps to move the phaser towards the advance position as shown by arrow 261. Fluid in the OPA retard chamber 217*d* exhausts from the chamber so sump through line 253.

To maintain the phase angle, the spool is positioned at null, as shown in FIG. 11, and cam torsional energy, oil pressure, and friction torque have to be balanced. In terms of the spool valve, the force of RPCS valve 200 and the spring 218 are balanced and the spool 204 is positioned such that spool land 204*a* blocks line 212, spool land 204*b* blocks line 214, and line 216 is open. Makeup oil from the supply 219 flows through line 208 and inlet check valve 254 to the spool valve 209. From the spool valve 209, fluid moves through central line 216 to fill both CTA chambers 217*a*, 217*b*. Fluid supplied to the spool valve 209 is also directed through the central passage 225 to line 245 to supply fluid to the OPA advance chamber 217*c*. In this position, the force of the pressure of fluid in line 207 and from line 210 is greater than the spring 300*b* in the locking pin 300, and the pin is moved to an unlocked position.

Figure 12:
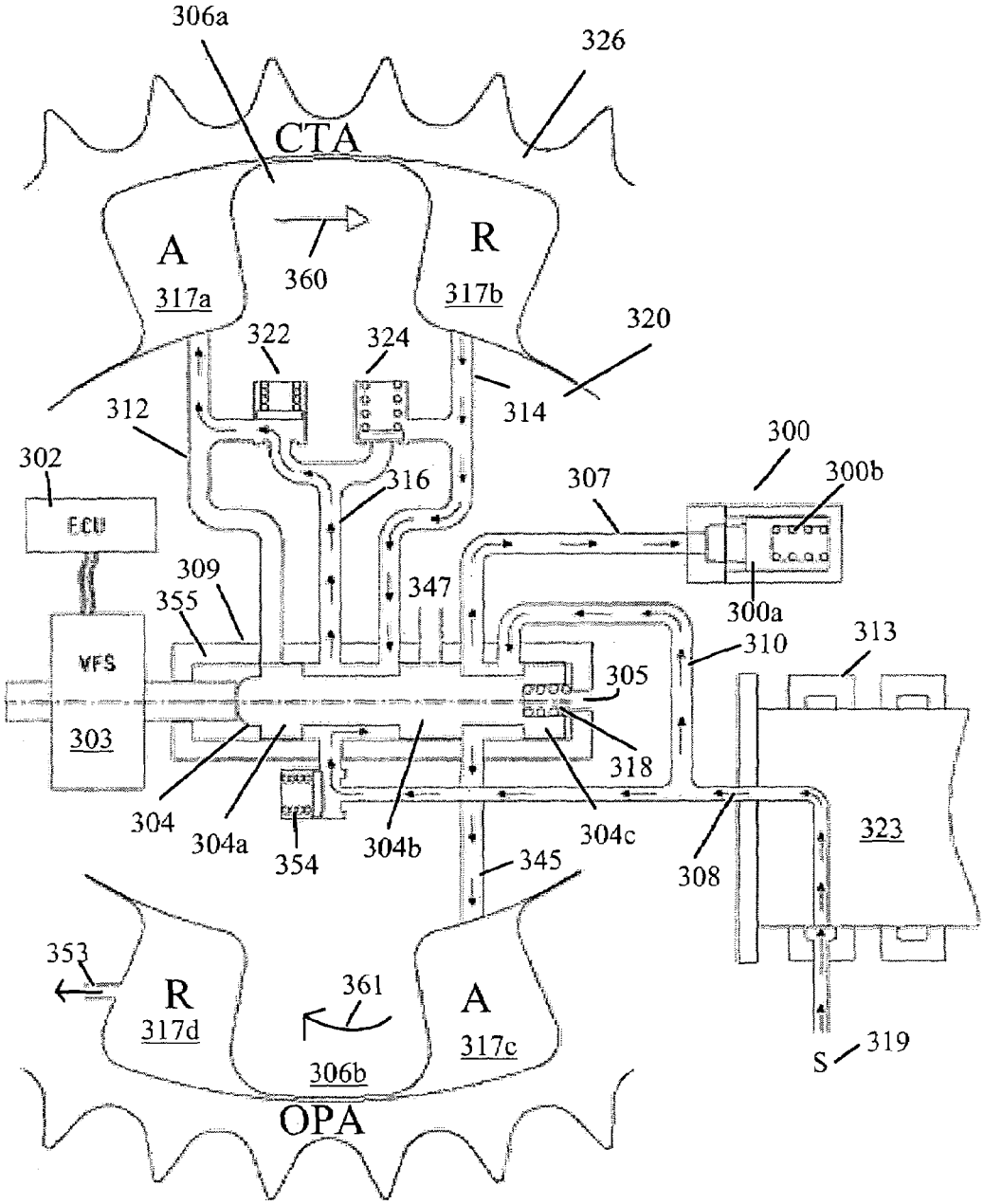
FIG. 12 shows a schematic of the third embodiment of the present invention moving towards the advance position.
Figure 13:
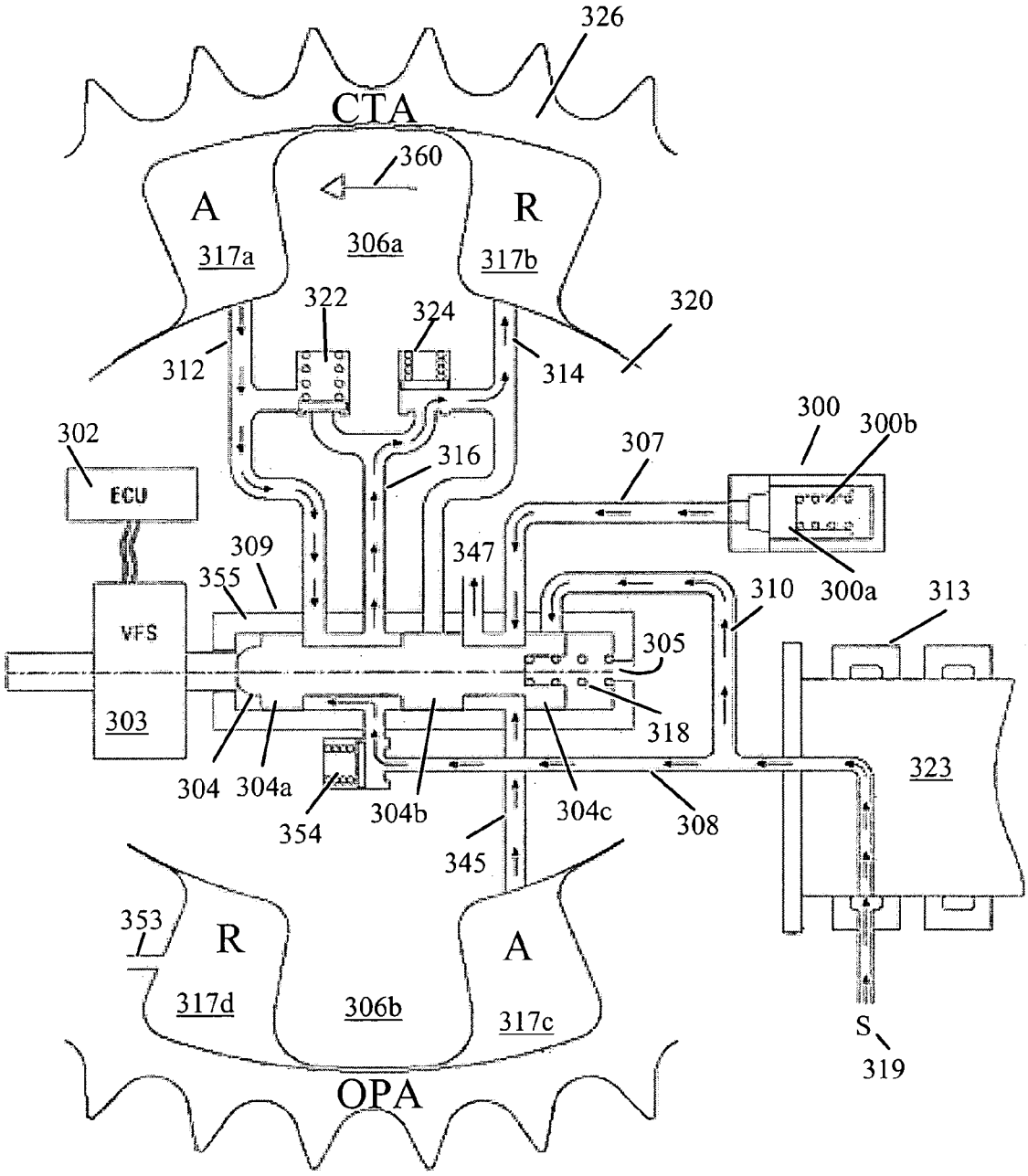
FIG. 13 shows a schematic of the third embodiment of the present invention moving towards the retard position.
Figure 14:
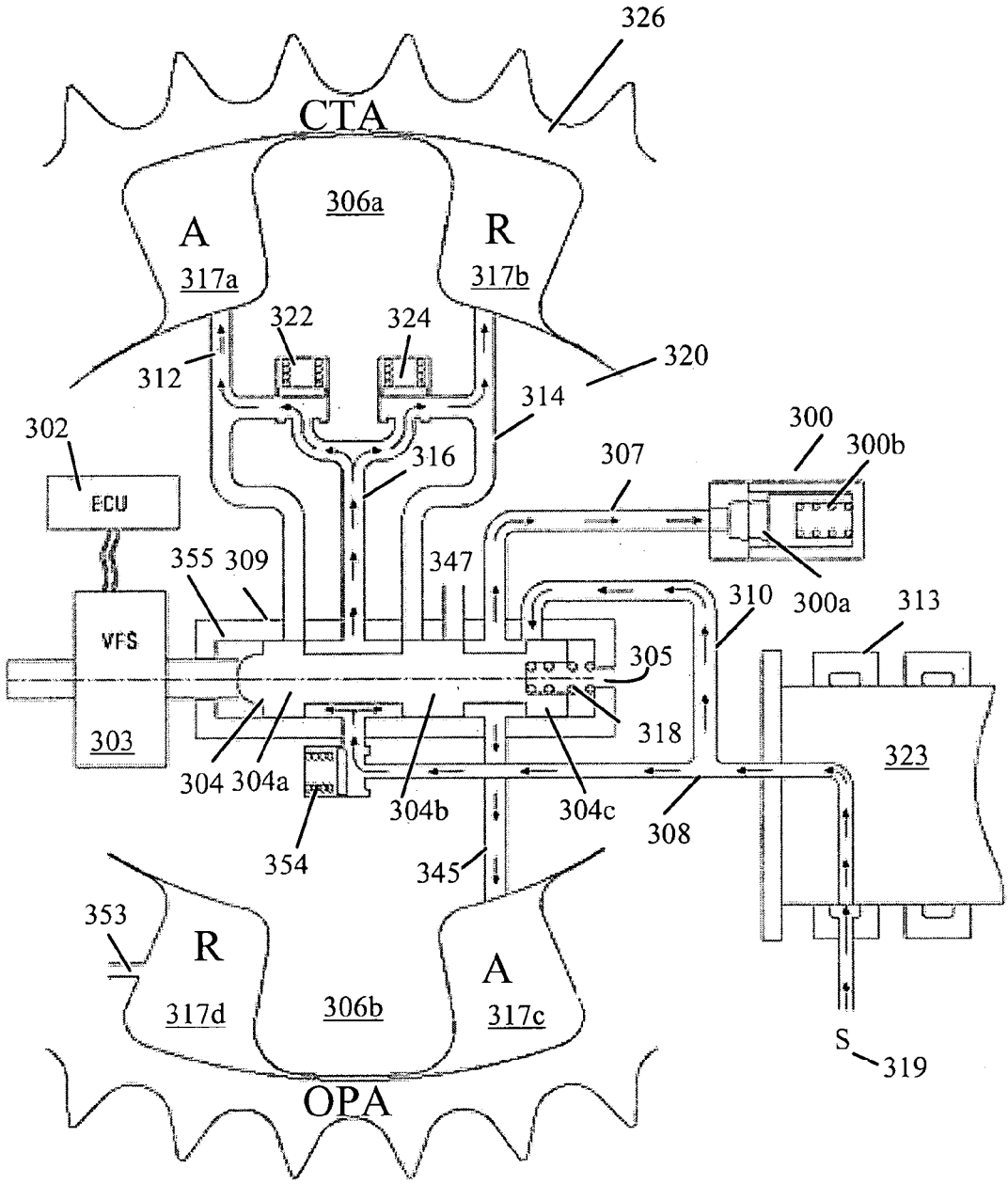
FIG. 14 shows a schematic of the third embodiment of the present invention in the null position.

FIGS. 12 through 14 show a phaser of a third embodiment. FIG. 12 shows the phaser moving towards the advance position. FIG. 13 shows the phaser moving towards the retard position. FIG. 14 shows the phaser in the null position. In this embodiment, supplies for the CTA portion of the phaser and the OPA portion of the phaser are provided separately. By separating the supplies for the OPA and the CTA portions of the phaser with inlet check valve 354, an unrestricted supply to the OPA advance chamber 317*c* is provided for the OPA portion of the phaser only, since it is not necessary for the CTA portion of the phaser. Furthermore, by isolating the supplies to the different portions of the phaser, the supplies are less sensitive to aeration, which can increase oscillation.

As stated earlier, in reference to FIG. 8, CTA phasers have a low actuation rate at high speeds. However, OPA and TA phasers have a high actuation rate at high speeds. By using a phaser with both CTA and OPA or TA portions, the phaser has a high actuation rate at both high and low speeds, resulting in satisfactory engine performance.

The housing 326 of the phaser has an outer circumference for accepting drive force. The rotor 320 is connected to the camshaft and is coaxially located within the housing 326. The rotor 320 has a first vane 306*a*, which is CTA and a second vane 306*b*, which is OPA, with the CTA vane 306*a* separating a first chamber formed between the housing 326 and the rotor 320 into the CTA advance chamber 317*a* and CTA retard chamber 317*b*, and the OPA vane 306*b* separating a second chamber formed between the housing 326 and the rotor 320 into the OPA advance chamber 317*c* and the OPA retard chamber 317*d*. The CTA and OPA vanes 306*a*, 306*b* are capable of rotation to shift the relative angular position of the housing 326 and the rotor 320.

The spool valve 309 includes a spool 304 with cylindrical lands 304*a*, 304*b*, and 304*c* slidably received in a sleeve 355 in the rotor 320. The sleeve 355 has a first end which receives the variable force solenoid (VFS) 303 and a second end which has an opening or a vent 305 that leads to atmosphere or sump. The position of the spool 309 is influenced by spring 318 and the VFS 303, which is controlled by the ECU 302. The position of the spool 304 controls the motion (e.g. to move towards the advance position or the retard position) of the phaser.

Locking pin 300 is slidably located in a radial bore in the rotor comprising a body 300*a* having a diameter adapted for a fluid-tight fit in the radial bore. The locking pin 300 is biased to an unlocked position when the pressure of the fluid from line 307 is greater than the force of spring 300*b*. The locking pin 300 is locked when the pressure of the fluid in line 307 is less than the force of spring 300*b* biasing the body 300*a* of the locking pin.

Torque reversals in the camshaft caused by the forces of opening and closing engine valves move the CTA vane 306*a*. The CTA advance and retard chambers 317*a*, 317*b* are arranged to resist positive and negative torque pulses in the camshaft and are alternatively pressurized by the cam torque. The control valve or spool valve 309 in the CTA system allows the CTA vane 306*a* in the phaser to move, by permitting fluid flow from the advance chamber 317*a* to the retard chamber 317*b* or vice versa, depending on the desired direction of movement, as shown in FIGS. 12 and 13. Positive cam torsionals move the phaser towards the retard position, as shown in FIG. 13. Negative cam torsionals move the phaser towards the advance position, as shown in FIG. 12.

The OPA portion of the phaser of the third embodiment is oil pressure actuated (OPA). Line 345 from the spool valve 309 provides fluid to the OPA advance chamber 317*c*, moving the OPA vane 306*b*, causing fluid in the OPA retard chamber 317*d* to exhaust or vent through line 353 to sump, aiding in moving the phaser to the advance position.

In moving towards the retard position, as shown in FIG. 13, the force of the variable force solenoid (VFS) 303 was reduced and the spool 304 was moved to the left in the figure by spring 318, until the force of the spring 318 balances the force of the VFS 303. In the position shown, the spool land 304*b* blocks line 314, lines 312 and 316 are open, and the vane 306*a* can move towards the retard position. Camshaft torque pressurizes the CTA retard chamber 317*b*, causing fluid in the CTA advance chamber 317*a* to move into the CTA retard chamber 317*b* and the vane 306*a* to move in the direction indicated by arrow 360. Fluid exits from the CTA advance chamber 317*a* through line 312 to the spool valve 309. From the spool valve 309, fluid flow between spool lands 304*a* and 304*b* to central line 316 and line 314 leading to the CTA retard chamber 317*b*. As stated earlier, positive cam torsionals help move the CTA vane 306*a*.

At the same time, fluid exits the OPA advance chamber 317*c* into line 345 leading to the spool valve 309. From the spool valve 309, fluid vents through line 347 to sump between spool lands 304*b* and 304*c* or through opening 305 in the sleeve 355.

Makeup oil is supplied to the phaser from supply 319 to make up for leakage and enters line 308 and moves through inlet check valve 354 to the spool valve 309. From the spool valve 309, fluid enters line 316 and through either of the check valves 322, 324, depending on which is open to the CTA advance or retard chambers 317*a*, 317*b*. Fluid from line 308 also flows into line 310 which is blocked by spool land 304*c*. The locking pin 300 is moving to a locked position, since the fluid in line 307 is now open to vent line. 347.

In moving towards the advance position, as shown in FIG. 12, the force of the VFS 303 was increased and the spool 304 was moved to the right in the figure, until the force of the spring 318 balances the force of the VFS 303. In the position shown, the spool land 304*a* blocks line 312, spool land 304*b* blocks line 347, lines 314, 316, 310, and 347 are open, and the vane 306*a* can move towards the advance position. Camshaft torque pressurizes the CTA advance chamber 317*a*, causing fluid in the CTA retard chamber 317*b* to move into the CTA advance chamber 317*a* and vane 306*a* to move in the direction indicated by arrow 360. Fluid exits from the CTA retard chamber through line 314 to the spool valve 309 between spool lands 304*a* and 304*b* and recirculates back to line 316, line 312 and the CTA advance chamber 317*a*. As stated earlier, negative cam torsionals are used to move CTA vane 306*a*.

At the same time, fluid from the spool valve 309 enters the OPA advance chamber 317*c* through line 345, causing the OPA vane to move in the direction indicated by arrow 361, aiding in moving the phaser to the advance position. Fluid in the OPA retard chamber 317*d* exits to sump through line 353.

Makeup oil is supplied to the phaser from supply 319 to make up for leakage and enters line 308 and moves through inlet check valve 354 to the spool valve 309. From the spool valve 309 fluid enters line 316 and through either of the check valves 322, 324, depending on which is open to the CTA advance or retard chambers 317*a*, 317*b*. Fluid from line 308 also flows into line 310. Since the spool 304 is in the position shown, fluid can flow from line 310 to line 307 to unlock locking pin 300. The fluid flows from line 310 to line 307 between spool lands 304*b* and 304*c*.

To maintain the phase angle, the spool is positioned at null, as shown in FIG. 14, and cam torsional energy, oil pressure, and friction torque have to be balanced. In terms of the spool valve, the force of VFS 303 and the spring 318 are balanced and the spool 304 is positioned such that spool land 304*a* blocks line 312, spool land 304*b* blocks line 314 and 347, spool land 304*c* partially blocks line 310, and line 316 is open. Makeup oil from the supply 319 flows through line 308 and inlet check valve 354 to the spool valve 309. From the spool valve, fluid moves through central line 316 to fill both CTA chambers 317*a*, 317*b*. Fluid from line 308 also flows to line 310, which leads to the spool valve 309. Since spool land 304*c* partially blocks line 310, fluid can enter the spool valve between spool lands 304*b* and 304*c*, entering line 307 to move the locking pin 300 to an unlocked position and entering line 345 to supply fluid to the OPA advance chamber 317*c*.

Figure 15:
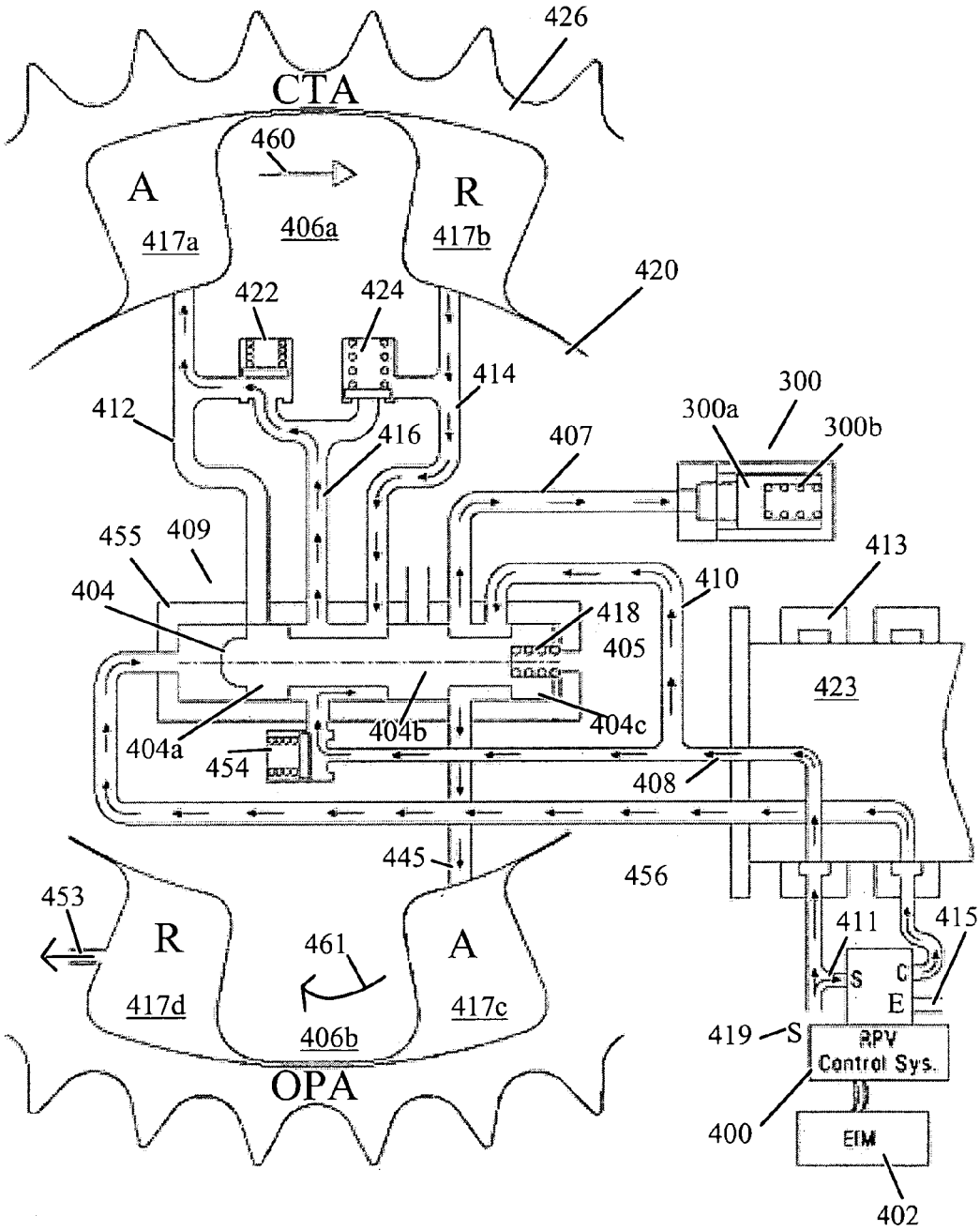
FIG. 15 shows a schematic of the fourth embodiment of the present invention moving towards the advance position.
Figure 16:
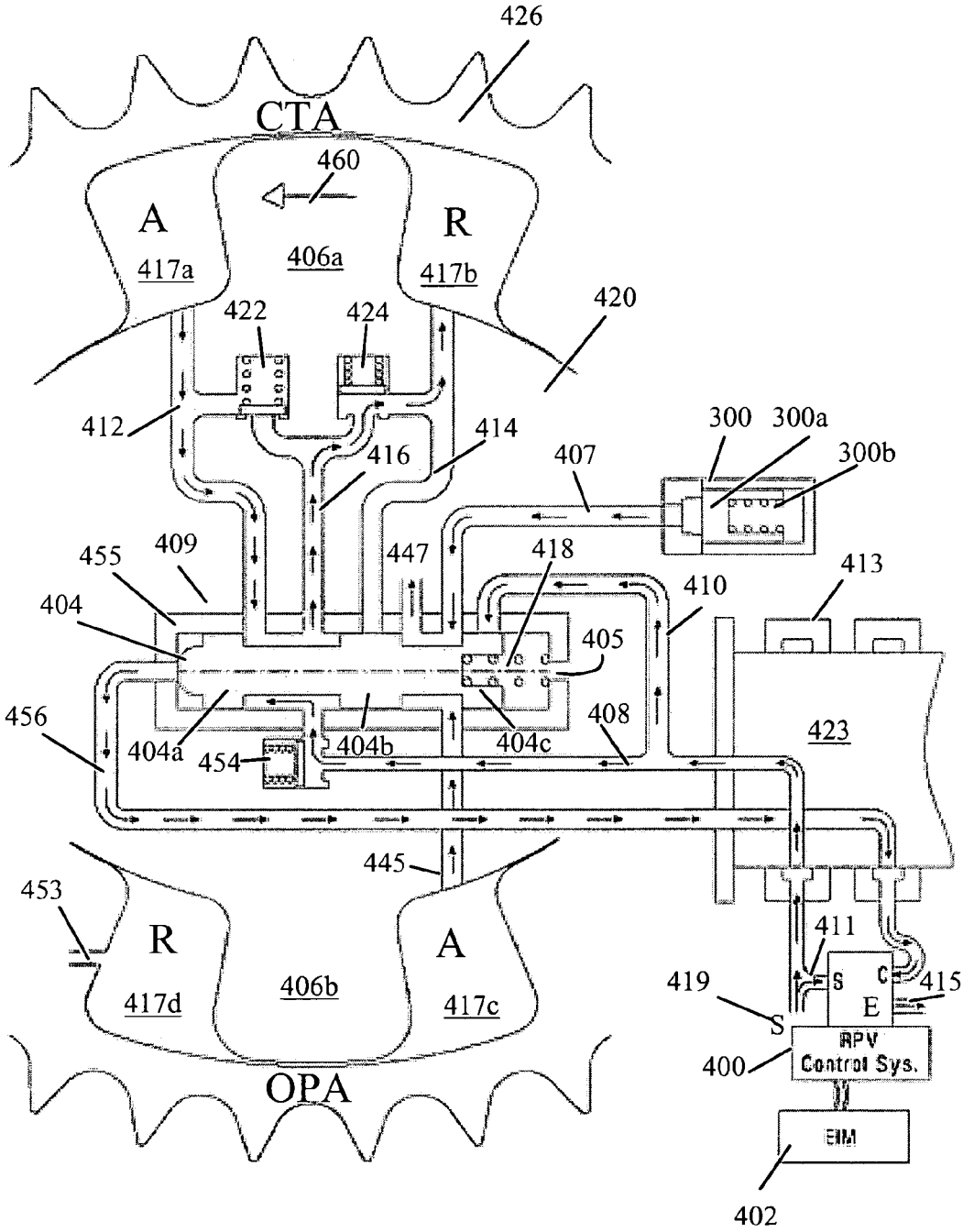
FIG. 16 shows a schematic of the fourth embodiment of the present invention moving towards the retard position.
Figure 17:
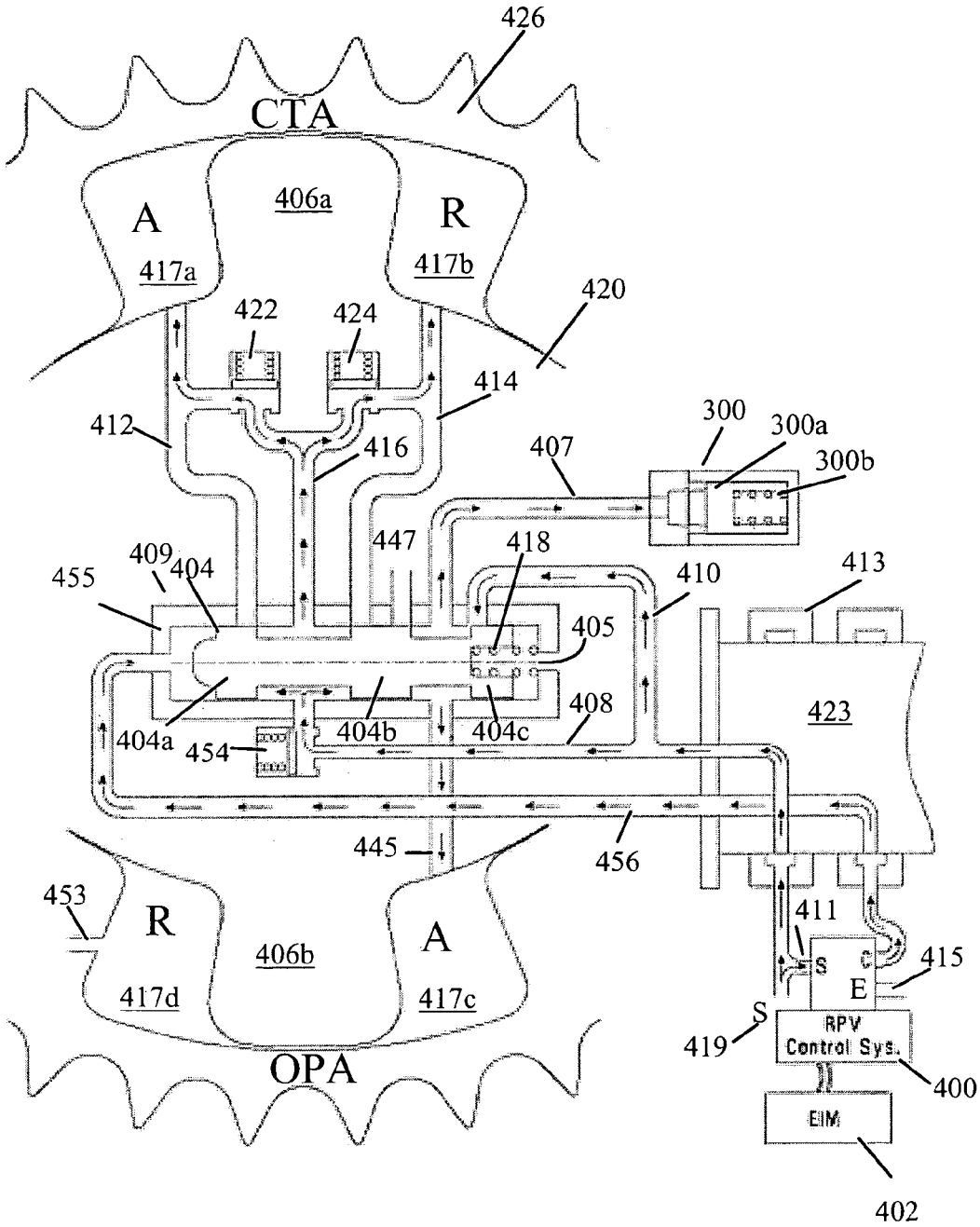
FIG. 17 shows a schematic a schematic of the fourth embodiment of the present invention in the null position.

FIGS. 15 through 17 show a phaser of a fourth embodiment. FIG. 15 shows the phaser moving towards the advance position. FIG. 16 shows the phaser moving towards the retard position. FIG. 17 shows the phaser in the null position. The phaser of the fourth embodiment has the advantages of the previous two embodiments. More specifically, supplies for the CTA portion of the phaser and the OPA portion of the phaser are provided separately. By separating the supplies for the OPA and the CTA portions of the phaser with inlet check valve 454, an unrestricted supply to the OPA advance chamber is provided for the OPA portion of the phaser only, since it is not necessary for the CTA portion of the phaser. Furthermore, by isolating the supplies to the different portions of the phaser, the supplies are less sensitive to aeration, which can increase oscillation. Furthermore, by using a regulated pressure valve control system, the overall axial package of the phaser is reduced. The RPCS is limited by its dependency on oil pressure and if the operating or supply pressure is lower than 1 bar, the spool travel may be limited and may limit phaser performance.

As stated earlier, in reference to FIG. 8, CTA phasers have a low actuation rate at high speeds. However, OPA or TA phasers have a high actuation rate at high speeds. By using a phaser with both CTA and OPA or TA portions, the phaser has a high actuation rate at both high and low speeds, resulting in satisfactory engine performance.

The housing 426 of the phaser has an outer circumference for accepting drive force. The rotor 420 is connected to the camshaft and is coaxially located within the housing 426. The rotor 420 has a first vane 406*a*, which is CTA and a second vane 406*b*, which is OPA, with the CTA vane 406*a* separating a first chamber formed between the housing 426 and the rotor 420 into the CTA advance chamber 417*a* and CTA retard chamber 417*b*, and the OPA vane 406*b* separating a second chamber formed between the housing 426 and the rotor 420 into the OPA advance chamber 417*c* and the OPA retard chamber 417*d*. The CTA and OPA vanes 406*a*, 406*b* are capable of rotation to shift the relative angular position of the housing 426 and the rotor 420.

The spool valve 409 includes a spool 404 with cylindrical lands 404*a*, 404*b*, and 404*c* slidably received in a sleeve 455 in the rotor 420. The sleeve 455 has a first end which receives line 456 and a second end which has an opening or vent 405 that leads to atmosphere. The position of the spool 404 is influenced by spring 418 and a regulated pressure valve control system 400, which is controlled by the ECU 402. The regulated pressure valve control system 400 is also disclosed in a provisional application No. 60/676,771 entitled, "TIMING PHASER CONTROL SYSTEM," filed on May 2, 2005 and is hereby incorporated by reference. The position of the spool 404 controls the motion (e.g. to move towards the advance position or the retard position), of the phaser.

The regulated pressure valve control system (RPCS) valve 400 is located remotely from the phaser in the cylinder head or in the cam bearing cap 423 as shown and receives fluid from supply through line 411 via line 408. The RPCS valve 400 also has an exhaust port E leading to line 415 and a control port C leading to line 456 through the cam bearing cap 423 to the first end of the sleeve 455. The RPCS valve 400 regulates the control pressure from 0 to 1 bar. The control pressure is proportional to the current of the valve. The current of the valve ranges from about 0 to 1 amp. The control pressure crosses the cam bearing 423 and the pressure creates a force on the first end of the spool valve 409 through line 456. By having the control pressure pass across the cam bearing cap interface 423, the leakage between the control fluid and the supply fluid is minimized by the tight cam bearing clearances and/or the cam bearing seals. Furthermore, by using the regulated pressure valve control system, the overall axial package of the phaser is reduced. The RPCS is limited by its dependency on oil pressure and if the operating or supply pressure is lower than 1 bar, the spool travel may be limited and may limit phaser performance.

Locking pin 300 is slidably located in a radial bore in the rotor comprising a body 300*a* having a diameter adapted for a fluid-tight fit in the radial bore. The locking pin 300 is biased to an unlocked position when the pressure of the fluid from line 407 is greater than the force of spring 300*b*. The locking pin is locked when the pressure of the fluid in line 407 is less than the force of spring 300*b* biasing the body 300*a* of the locking pin.

Torque reversals in the camshaft caused by the forces of opening and closing engine valves move the cam torque actuated CTA vane 406*a* or a first vane. The CTA advance and retard chambers 417*a*, 417*b* are arranged to resist positive and negative torque pulses in the camshaft and are alternatively pressurized by the cam torque. The control valve or the spool valve 409 in the CTA system allows the vane 406*a* in the phaser to move, by permitting fluid flow from the CTA advance chamber 417*a* to the CTA retard chamber 417*b* or vice versa, depending on the desired direction of movement, as shown in FIGS. 15 and 16. Positive cam torsionals move the phaser towards the retard position, as shown in FIG. 16. Negative cam torsionals move the phaser towards the advance position, as shown in FIG. 15.

The OPA portion of the phaser of the fourth embodiment is oil pressure actuated (OPA). Line 445 from the spool valve 409 provides fluid to the OPA advance chamber 417*c*, moving the OPA vane 406*b*, causing fluid in the OPA retard chamber 417*d* to exhaust or vent through line 453.

In moving towards the retard position, as shown in FIG. 16, the force of the control pressure from the RPCS valve 400 in line 456 was reduced and the spool 404 was moved to the left in the figure by spring 418, until the force of spring 418 balanced the force of the control pressure of the RPCS. With the spool 404 in this position, fluid in the sleeve 455 is forced out of the spool valve 409 through line 456 to the control port C of the RPCS valve 400. From the control port C of the RPCS valve, the fluid exhausts through the exhaust port E to line 415.

With the spool in the position shown, spool land 409*b* blocks line 414, spool land 409*c* blocks line 410, lines 412, 416, 408, and 447 are open, and the CTA vane 406*a* can move towards the retard position. Camshaft torque pressurizes the CTA retard chamber 417*b*, causing fluid in the CTA advance chamber 417*a* to move into the CTA retard chamber 417*b* and the CTA vane 406*a* to move in the direction indicated by arrow 460. Fluid exits the CTA advance chamber 417*a* through line 412 to the spool valve 404 between spool lands 404*a* and 404*b* and recirculates back to central line 416, line 414, and the CTA retard chamber 417*b*. As stated earlier, positive cam torsionals help move the vane 406*a*.

At the same time, fluid exits the OPA advance chamber 417*c* into line 445 and the spool valve 409. From the spool valve 409, fluid exits through vent 405 and line 447 to sump. With fluid exiting through line 407, and passing to exhaust line 447 between spool lands 404*b* and 404*b*, the locking pin 300 moves to a locked position.

Makeup oil is supplied to the phaser from supply 419 to make up for leakage and enters line 408 and moves through inlet check valve 454 to the spool valve 409. Line 410 branches off of line 408 and leads to the spool valve 409. From the spool valve 409, fluid moves to the OPA advance chamber 417*c* via line 445 and line 411, supplying fluid to the RPCS valve 400. The fluid from line 408 ,enters the spool valve and moves to line 416 and through either of the check valves 422, 424, depending on which is open to the CTA advance or retard chambers 417*a*, 417*b*.

In moving towards the advance position, as shown in FIG. 15, the force of the control pressure from the RPCS valve 400 in line 456 was increased and the spool 409 was moved to the right by spring 418, until the force of the spring 418 balanced the force of the control pressure of the RPCS. With the spool 404 in this position, spool land 409*a* blocks line 412, spool land 409*b* blocks exhaust line 447, lines 414, 416, and 407 are open and the CTA vane 406*a* can move towards the advance position. Camshaft torque pressurizes the CTA advance chamber 417*a*, causing fluid in the CTA retard chamber 417*b* to move into the CTA advance chamber 417*a*, and the CTA vane 406*a* to move in the direction indicated by arrow 460. Fluid exits the CTA retard chamber 417*b* through line 414 to the spool valve 404 between spool lands 409*a* and 409*b* and recirculates back to the central line 416, line 412 and the CTA advance chamber 417*a*. As stated earlier, negative cam torsionals help move the CTA vane 406*a*.

At the same time, fluid enters the OPA advance chamber 417*c* from line 445 and the spool valve 409, aiding in moving the phaser to the advance position.

Makeup oil is supplied to the phaser from supply 419 to makeup for leakage and enters line 408 and moves through inlet check valve 454 to the spool valve 409. From the spool valve, fluid enters line 416 and through either of the check valves 422, 424, depending on which is open to the CTA advance or retard chambers. Lines 410 and 411 branch off of line 408. Fluid in line 411 supplies the RPCS valve 400. From line 410, fluid enters the spool valve between spool lands 404*b* and 404*c* and fluid either enters line 407, moving the locking pin to an unlocked position or to line 445 supplying fluid to the OPA advance chamber 417*c*. The fluid in the OPA advance chamber 417*c* aids in moving the phaser towards the advance position as shown by arrow 461. Fluid in the OPA retard chamber 417*d* exhausts from the chamber through line 453.

To maintain the phase angle, the spool is positioned at null, as shown in FIG. 17, and cam torsional energy, oil pressure, and friction torque have to be balanced. In terms of the spool valve, the force of RPCS valve and the spring 418 are balanced and the spool is positioned such that spool land 404*a* blocks line 412, spool land 404*b* blocks lines 414 and 447, spool land 404*c* partially blocks line 410, and line 416 is open. Makeup oil from the supply 419 flows through line 408 and inlet check valve 454 to the spool valve. From the spool valve, fluid moves through central line 416 to fill both CTA chambers 417*a*, 417*b*. Fluid from partially blocked line 410 supplies the OPA advance chamber 417*c* with fluid and locking pin line 407, moving the locking pin to an unlocked position.

Figure 18:
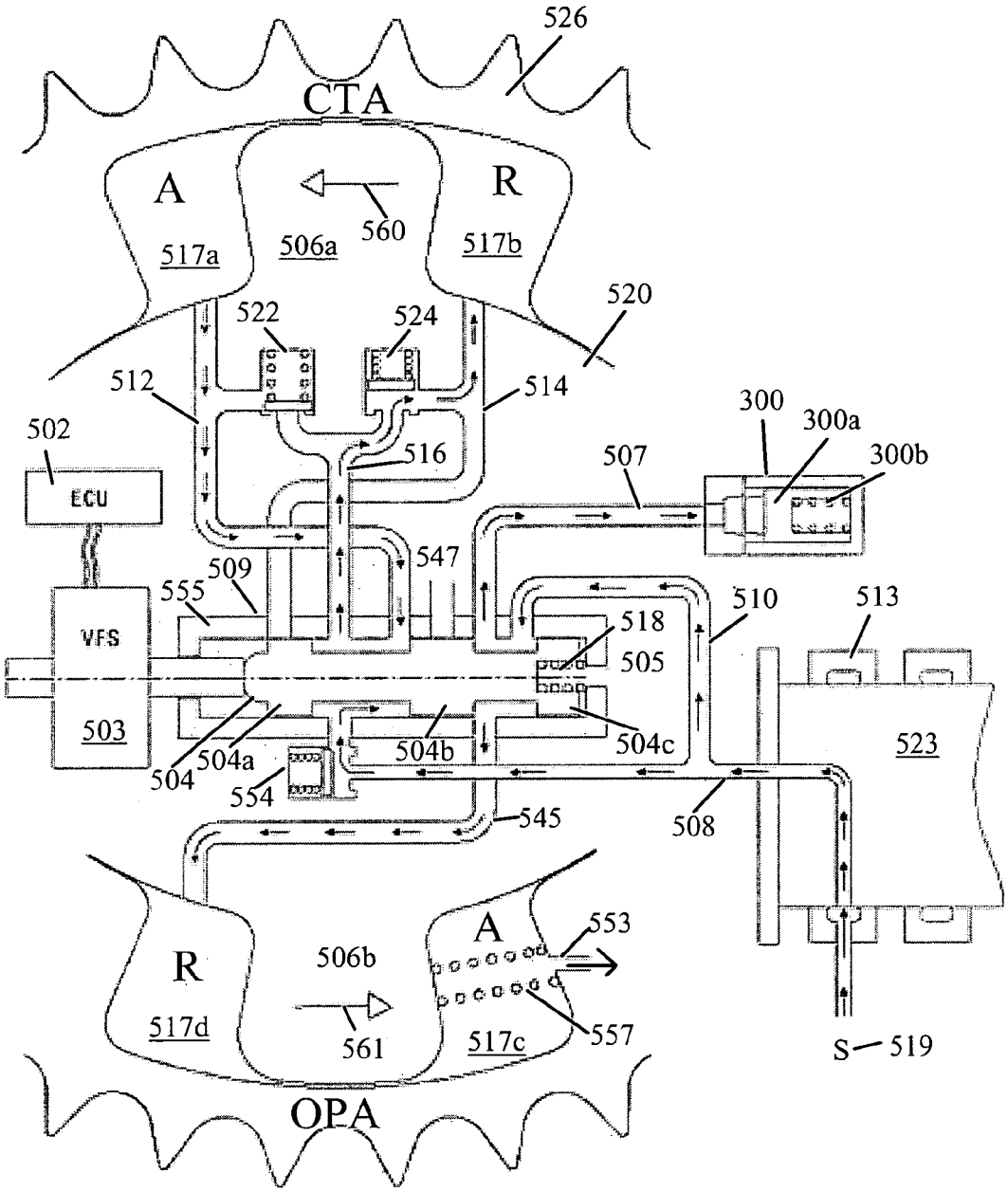
FIG. 18 shows a schematic a schematic of the fifth embodiment of the present invention moving towards the retard position.
Figure 19:
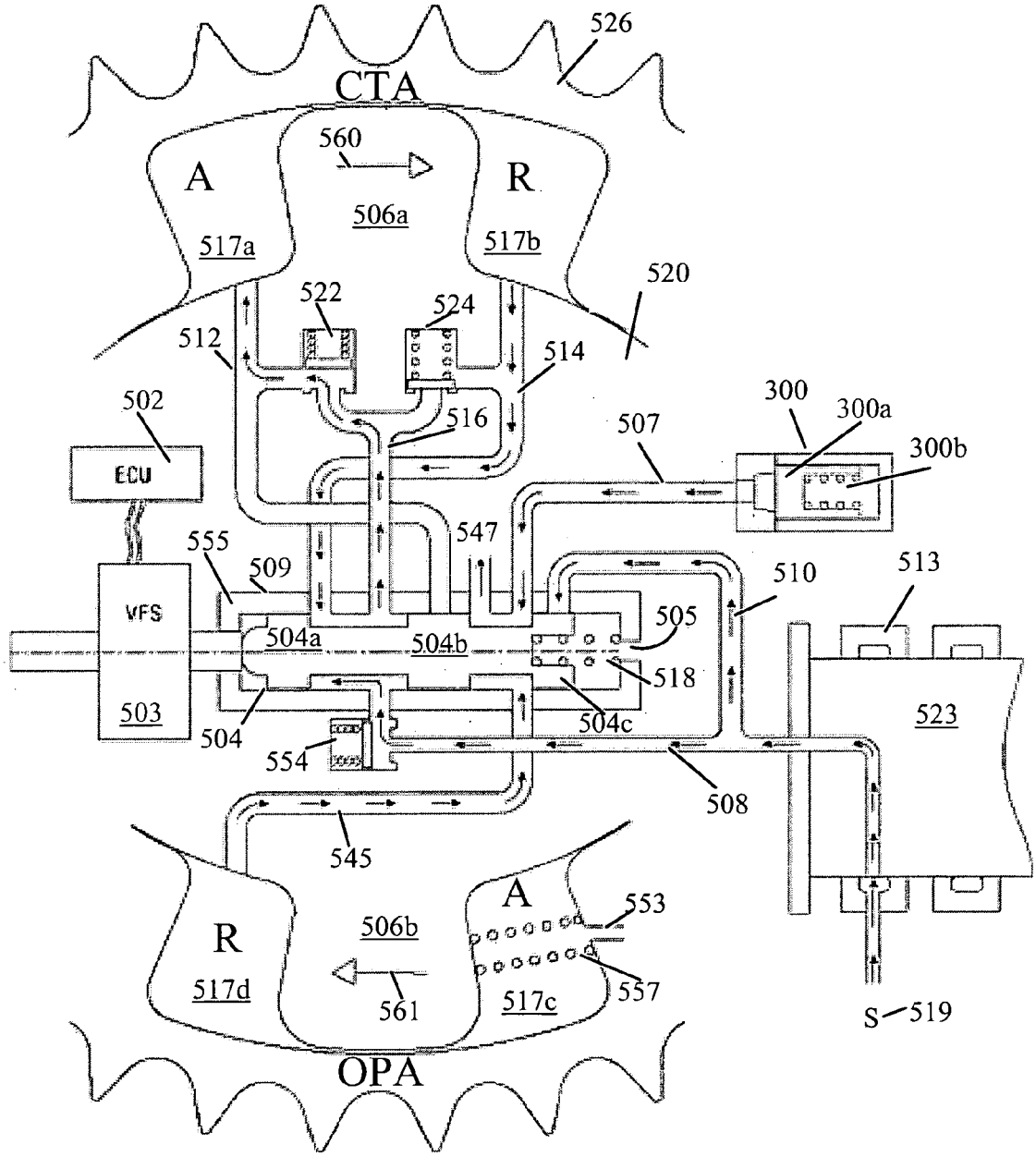
FIG. 19 shows a schematic a schematic of the fifth embodiment of the present invention moving towards the advance position.
Figure 20:
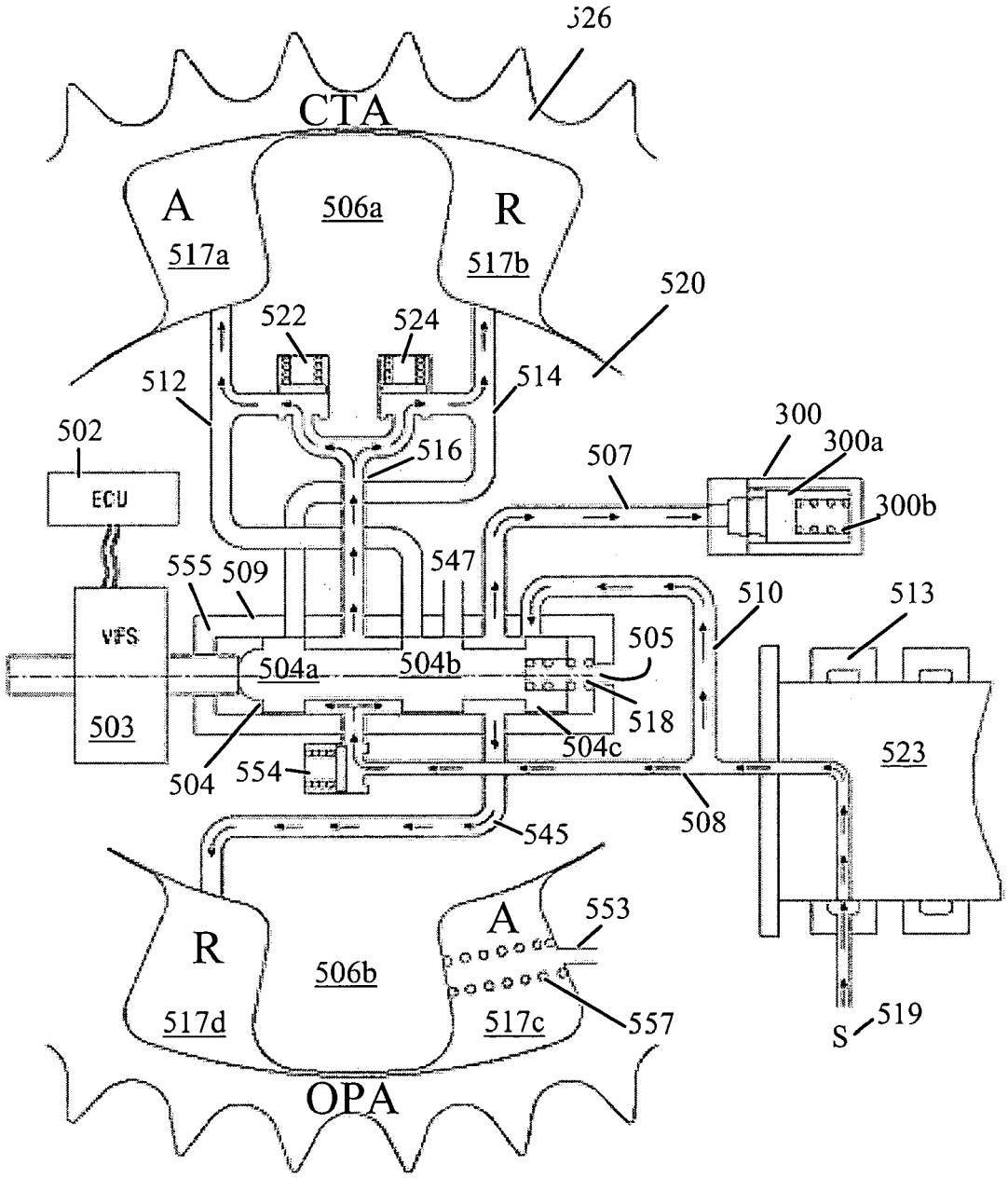
FIG. 20 shows a schematic a schematic of the fifth embodiment of the present invention in the null position.

FIGS. 18 through 20 show a phaser of a fifth embodiment. FIG. 18 shows the phaser moving towards the retard position. FIG. 19 shows the phaser moving towards the advance position. FIG. 20 shows the phaser in the null position.

As stated earlier, in reference to FIG. 8, CTA phasers have a low actuation rate at high speeds. However, OPA and TA phasers have a high actuation rate at high speeds. By using a phaser with both CTA and OPA or TA portions, the phaser has a high actuation rate at both high and low speeds, resulting in satisfactory engine performance.

The housing 526 of the phaser has an outer circumference for accepting drive force. The rotor 520 is connected to the camshaft and is coaxially located within the housing 526. The rotor 520 has a first vane 506*a*, which is CTA and a second vane 506*b*, which is OPA, with the CTA vane 506*a* separating a first chamber formed between the housing 526 and the rotor 520 into the CTA advance chamber 517*a* and CTA retard chamber 517*b*, and the OPA vane 506*b* separating a second chamber formed between the housing 526 and the rotor 520 into the OPA advance chamber 517*c* and the OPA retard chamber 517*d*. The CTA and OPA vanes 506*a*, 506*b* are capable of rotation to shift the relative angular position of the housing 526 and the rotor 520.

The spool valve 509 includes a spool 504 with cylindrical lands 504*a*, 504*b*, and 504*c* slidably received in a sleeve 555 in the rotor 520. The sleeve 555 has a first end which receives the variable force solenoid (VFS) 503 and a second end which has opening or a vent 505 that leads to atmosphere. The position of the spool 504 is influenced by spring 518 and the VFS 503, which is controlled by the ECU 502. The position of the spool 504 controls the motion (e.g. to move towards the advance position or the retard position) of the phaser.

Locking pin 300 is slidably located in a radial bore in the rotor comprising a body 300*a* having a diameter adapted for a fluid-tight fit in the radial bore. The locking pin 300 is biased to an unlocked position when the pressure of the fluid from line 507 is greater than the force of spring 300*b*. The locking pin is locked when the pressure of the fluid in line 507 is less than the force of spring 300*b* biasing the body 300*a* of the locking pin.

Torque reversals in the camshaft caused by the forces of opening and closing engine valves move the cam torque actuated CTA vane 506*a*. The CTA advance and retard chambers 517*a*, 517*b* are arranged to resist positive and negative torque pulses in the camshaft and are alternatively pressurized by the cam torque. The control valve or spool valve 509 in the CTA system allows the vane 506*a* in the phaser to move, by permitting fluid flow from the advance chamber 517*a* to the retard chamber 517*b* or vice versa, depending on the desired direction of movement, as shown in FIGS. 18 and 19. Positive cam torsionals help to move the phaser towards the retard position, as shown in FIG. 18. Negative cam torsionals help to move the phaser towards the advance position, as shown in FIG. 19.

The OPA portion of the phaser of the fifth embodiment is oil pressure actuated (OPA) to aid in retarding the phaser and spring biased to an advance position. Line 545 from the spool valve 509 provides fluid to the OPA retard chamber 517*d*. Spring 557 biases the OPA vane 506*b* to the advance position. When the OPA vane 506*b* is moved to the retard position, as indicated by arrow 561, the spring 557 in the OPA advance chamber 517*c* is compressed and any fluid in the chamber is exhausted through line 553. When the OPA vane 506*b* is moved to the advance position, spring 557 in the OPA advance chamber 517*c* stretches and fluid exits the retard chamber through line 545.

In moving towards the retard position, as shown in FIG. 18, the force of the variable force solenoid (VFS) 503 was increased and the spool 504 was moved to the right in the figure, until the force of the spring 518 balances the force of the VFS 503. In the position shown, the spool land 504*a* blocks line 514, spool land 504*b* blocks exhaust line 547, and lines 516, 512, 507, and 510 are open and vane 506*a* can move towards the retard position. Camshaft torque pressurizes the CTA retard chamber 517*b*, causing fluid in the CTA advance chamber 517*a* to move into the CTA retard chamber 517*b* and the vane 506*a* to move in the direction indicated by arrow 560. Fluid exits from the CTA advance chamber 517*a* through line 512 to the spool valve 509. From the spool valve 509, fluid flow between spool lands 504*a* and 504*b* to central line 516 and line 514 leading to the CTA retard chamber 517*b*. As stated earlier, positive cam torsionals help to move vane 506*a*.

At the same time, fluid from the spool valve enters the OPA retard chamber 517*d* through line 545, moving the OPA vane 506*b* in the direction indicated by arrow 561, compressing spring 557 and causing any fluid in the OPA advance chamber 517*c* to exhaust through line 553.

Makeup oil is supplied to the phaser from supply 519 to make up for leakage and enters line 508 and moves through inlet check valve 554 to the spool valve 509. From the spool valve fluid enters line 516 and through either of the check valves 522, 524, depending on which is open to the CTA advance or retard chambers 517*a*, 517*b*. Fluid from line 508 also flows into line 510 to the spool valve between spool lands 504*b* and 504*c*. Fluid in the spool valve between lands 504*b* and 504*c* from line 510 flows to line 507 to move the locking pin 300 to an unlocked position and to line 545, supplying fluid to the OPA retard chamber 517*d*.

In moving towards the advance position, as shown in FIG. 19, the force of the VFS 503 was reduced and the spool 504 was moved to the left in the figure by spring 518, until the force of the spring 518 balances the force of the VFS 503. In the position shown, spool land 504*b* blocks line 512, spool land 504*c* blocks line 510, and lines 514, 516, 507, and 547 are open and vane 506*a* can move towards the advance position. Camshaft torque pressurizes the CTA advance chamber 517*a*, causing fluid in the CTA retard chamber 517*b* to move into the CTA advance chamber 517*a* and the vane 506*a* to move in the direction indicated by arrow 560. Fluid exits from the CTA retard chamber 517*b* through line 514 to the spool valve 509. From the spool valve 509, fluid flow between spool lands 504*a* and 504*b* to central line 516 and line 512 leading to the CTA advance chamber 517*a*. As stated earlier, negative cam torsionals help in moving CTA vane 506*a*.

At the same time, fluid exits the OPA retard chamber 517*d* into line 545 leading to the spool valve 509. From the spool valve 509, fluid vents through line 547 to sump between spool lands 504*b* and 504*c* or through opening 505 in the sleeve 555. With the vane 506*b* in this position and moving in the direction indicated by arrow 561, spring 557 extends.

Makeup oil is supplied to the phaser from supply 519 to make up for leakage and enters line 508 and moves through inlet check valve 554 to the spool valve 509. From the spool valve fluid enters line 516 and through either of the check valves 522, 524, depending on which is open to the CTA advance or retard chambers 517*a*, 517*b*. Fluid from line 508 also flows into line 510, which is blocked by spool land 504*c*. With the spool in this position, the locking pin 300 is moving to a locked position, since the fluid in line 507 is now open to vent line 547.

To maintain the phase angle, the spool is positioned at null, as shown in FIG. 20, cam torsional energy, oil pressure, and friction torque have to be balanced. In terms of the spool valve, the force of VFS 503 and the spring 518 are balanced and the spool is positioned such that spool land 504*a* blocks line 514, spool land 504*b* blocks line 512 and 547, spool land 504*c* partially blocks line 510, and line 516 is open. Makeup oil from the supply 519 flows through line 508 and inlet check valve 554 to the spool valve 509. From the spool valve, fluid moves through central line 516 to fill both CTA chambers 517*a*, 517*b*. Fluid from line 508 also flows to line 510, which leads to the spool valve 509. Since spool land 504*c* partially blocks line 510, fluid can enter the spool vale between spool lands 504*b* and 504*c* and fluid can enter line 507 to move the locking pin 300 to an unlocked position and enter line 545 to supply fluid to the OPA retard chamber 517*d*.

Spring 557 may be a compression spring, a torsion spring, or a spiral spring. The bias of the spring must be great enough to bias over the cam friction of the variable cam timing system.

Furthermore, the above embodiment may also use a RPCS valve in place of the VFS 503.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine having at least one camshaft comprising:

a housing having an outer circumference for accepting drive force;

a rotor for connection to the camshaft coaxially located within the housing, the housing and the rotor defining at least two vanes separating chambers in the housing into advance chambers and retard chambers;

a plurality of vanes in the chambers defined by the housing, wherein at least one vane is cam torque actuated and at least one other vane is oil pressure actuated, wherein the cam torque actuated vane defines a cam torque actuated advance chamber and a cam torque actuated retard chamber between the cam torque actuated vane and the housing and the oil pressure actuated vane defines an oil pressure actuated retard chamber having an exhaust line and an oil pressure actuated advance chamber and between the oil pressure actuated vane and the housing;

a spool valve located along a rotational axis of the phaser comprising a spool having a plurality of lands slidably received in a sleeve in the rotor, a central passage extending between the a first land and a third land, and a spring biasing the spool, the sleeve having a first end coupled to a control pressure line from a regulated pressure valve control system and a second end vented to atmosphere, the regulated pressure valve control system including a supply input for receiving pressurized fluid from a supply, a control pressure output, and an exhaust output;

wherein when the phaser is in a retard position, fluid is routed from the cam torque actuated advance chamber to the cam torque actuated retard chamber and wherein the force of the spring biasing the spool is greater than the control pressure output, and the control pressure output is routed back to the regulated pressure valve control valve and to the exhaust output; and wherein when the phaser is in an advance position, fluid is routed from the cam torque actuated retard chamber to the cam torque actuated advance chamber and wherein the control pressure output from the regulated pressure valve control system is greater than the spring biasing the spool, and fluid from a supply of pressurized fluid is routed through the central passage to the oil pressure actuated advance chamber.

2. The variable camshaft timing phaser of claim 1, further comprising:

a locking pin controlled by the control pressure output of the regulated pressure valve control system, slidably located in a radial bore, comprising a body having a diameter adapted to a fluid-tight fit in the radial bore, and an inner end toward the housing or the rotor adapted to fit in a receiving hole defined by the housing or the rotor, the locking pin being radially movable in the bore from a locked position in which the inner end fits into the receiving hole defined by the housing or the rotor, to an unlocked position in which the inner end does not engage the receiving hole defined by the housing or the rotor.

3. The variable camshaft timing phaser of claim 2, wherein the locking pin is in the unlocked position when the phaser is in the advance position and the locking pin is in the locked position when the phaser is in the retard position.

4. The variable camshaft timing phaser of claim 1, wherein the regulated pressure valve control system is located remotely from the phaser.

5. The variable camshaft timing phaser of claim 4, wherein the regulated pressure valve control system is located in the cylinder head or the cam bearing cap.

6. The variable camshaft timing phaser of claim 1, wherein the regulated pressure valve control system regulates the control pressure from 0 to 1 bar and is proportional to a current of the valve.

7. The variable camshaft timing phaser of claim 6, wherein the current of the valve is 0 to 1 amp.

8. The variable camshaft timing phaser of claim 1, wherein the control pressure output crosses the cam bearing.

9. The variable camshaft timing phaser of claim 1, further comprising a check valve in the pressurized supply of fluid.

10. The variable camshaft timing phaser of claim 1, wherein when the phaser is in the advance position, fluid exhausts from the oil pressure actuated retard chamber through the exhaust line.

11. A variable camshaft timing phaser for an internal combustion engine having at least one camshaft comprising:

a housing having an outer circumference for accepting drive force;

a rotor for connection to a camshaft coaxially located within the housing, the housing and the rotor defining at least two vanes separating chambers in the housing into advance chambers and retard chambers;

a plurality of vanes in the chambers defined by the housing, wherein at least one vane is cam torque actuated and at least one other vane is oil pressure actuated; wherein the cam torque actuated vane defines a cam torque actuated advance chamber and a cam torque actuated retard chamber between the cam torque actuated vane and the housing and the oil pressure actuated vane defines an oil pressure actuated retard chamber having an exhaust line and an oil pressure actuated advance chamber between the oil pressure actuated vane and the housing;

a spool valve located along a rotational axis of the phaser comprising a spool having a plurality of lands slidably received in a sleeve in the rotor and a spring biasing the spool, the sleeve having a first end and a second end vented to atmosphere;

a first supply route of pressurized fluid supplying makeup fluid to the cam torque actuated advance chamber and the cam torque actuated retard chamber; and a second supply route of pressurized fluid supplying fluid to the oil pressure actuated advance chamber;

wherein when the phaser is in a retard position, wherein fluid is routed from the cam torque actuated advance chamber to the cam torque actuated retard chamber;

wherein when the phaser is in an advance position, wherein fluid is routed from the cam torque actuated retard chamber to the cam torque actuated advance chamber and fluid is routed to the oil pressure actuated advance chamber from the second supply route.

12. The variable camshaft timing phaser of claim 11, further comprising a check valve in the first supply route.

13. The variable camshaft timing phaser of claim 11, wherein when the phaser is in the advance position, fluid exhausts from the oil pressure actuated retard chamber through the exhaust line.

14. The variable camshaft timing phaser of claim 11, further comprising a variable force solenoid received by the first end of the sleeve for biasing the spool against the spring.

15. The variable camshaft timing phaser of claim 11, further comprising:

a locking pin controlled by fluid from the second supply route, slidably located in a radial bore, comprising a body having a diameter adapted to a fluid-tight fit in the radial bore, and an inner end toward the housing or the rotor adapted to fit in a receiving hole defined by the housing or the rotor, the locking pin being radially movable in the bore from a locked position in which the inner end fits into the receiving hole defined by the housing or the rotor, to an unlocked position in which the inner end does not engage the receiving hole defined by the housing or the rotor.

16. The variable camshaft timing phaser of claim 15, wherein the locking pin is in the unlocked position when the phaser is in the advance position and the locking pin is in the locked position when the phaser is in the retard position.

17. A variable camshaft timing phaser for an internal combustion engine having at least one camshaft comprising:

a housing having an outer circumference for accepting drive force;

a rotor for connection to a camshaft coaxially located within the housing, the housing and the rotor defining at least two vanes separating chambers in the housing into advance chambers and retard chambers;

a plurality of vanes in the chambers defined by the housing, wherein at least one vane is cam torque actuated and at least one other vane is oil pressure actuated, wherein the cam torque actuated vane defines a cam torque actuated advance chamber and a cam torque actuated retard chamber between the cam torque actuated vane and the housing and the oil pressure actuated vane defines an oil pressure actuated retard chamber having an exhaust line and an oil pressure actuated advance chamber between the oil pressure actuated vane and the housing;

a spool valve located along a rotational axis of the phaser comprising a spool having a plurality of lands slidably received in a sleeve in the rotor and a spring biasing the spool, the sleeve having a first end coupled to a control pressure line from a regulated pressure valve control system and a second end vented to atmosphere, the regulated pressure valve control system having a supply input for receiving pressurized fluid from a supply of pressurized fluid, a control pressure output and an exhaust output;

a first supply route of pressurized fluid supplying makeup fluid to the cam torque actuated advance chamber and the cam torque actuated retard chamber;

wherein when the phaser is in a retard position, wherein fluid is routed from the cam torque actuated advance chamber to the cam torque actuated retard chamber and wherein the force of the spring biasing the spool is greater than the control pressure output, and the control pressure output is routed back to the regulated pressure valve control valve and to the exhaust output; and wherein when the phaser is in an advance position, wherein fluid is routed from the cam torque actuated retard chamber to the cam torque actuated advance chamber and wherein the control pressure output from the regulated pressure valve control system is greater than the spring biasing the spool, and fluid from a second supply of pressurized fluid is routed through the spool valve to the oil pressure actuated advance chamber.

18. The variable camshaft timing phaser of claim 17, further comprising:

a locking pin controlled by fluid from the second supply route, slidably located in a radial bore, comprising a body having a diameter adapted to a fluid-tight fit in the radial bore, and an inner end toward the housing or the rotor adapted to fit in a receiving hole defined by the housing or the rotor, the locking pin being radially movable in the bore from a locked position in which the inner end fits into the receiving hole defined by the housing or the rotor, to an unlocked position in which the inner end does not engage the receiving hole defined by the housing or the rotor.

19. The variable camshaft timing phaser of claim 18, wherein the locking pin is in the unlocked position when the phaser is in the advance position and the locking pin is in the locked position when the phaser is in the retard position.

20. The variable camshaft timing phaser of claim 17, wherein the regulated pressure valve control system is located remotely from the phaser.

21. The variable camshaft timing phaser of claim 20, wherein the regulated pressure valve control system is located in the cylinder head or in the cam bearing cap.

22. The variable camshaft timing phaser of claim 17, wherein the regulated pressure valve control system regulates the control pressure from 0 to 1 bar and is proportional to a current of the valve.

23. The variable camshaft timing phaser of claim 22, wherein the current of the valve is 0 to 1 amp.

24. The variable camshaft timing phaser of claim 17, wherein the control pressure output crosses the cam bearing.

25. The variable camshaft timing phaser of claim 17, further comprising a check valve in the first supply route.

26. The variable camshaft timing phaser of claim 17, wherein when the phaser is in the advance position, fluid exhausts from the oil pressure actuated retard chamber through the exhaust line.

27. A variable camshaft timing phaser for an internal combustion engine having at least one camshaft comprising:

a housing having an outer circumference for accepting drive force;

a rotor for connection to a camshaft coaxially located within the housing, the housing and the rotor defining at least two vanes separating chambers in the housing into advance chambers and retard chambers;

a plurality of vanes in the chambers defined by the housing, wherein at least one vane is cam torque actuated and at least one other vane is oil pressure actuated, wherein the cam torque actuated vane defines a cam torque actuated advance chamber and a cam torque actuated retard chamber between the cam torque actuated vane and the housing and the oil pressure actuated vane defines an oil pressure actuated advance chamber having an exhaust line and a bias spring between the housing and the oil pressure actuated vane and an oil pressure actuated retard chamber between the oil pressure actuated vane and the housing;

a spool valve located along a rotational axis of the phaser comprising a spool having a plurality of lands slidably received in a sleeve in the rotor and a spring biasing the spool, the sleeve having a first end and a second end vented to atmosphere;

a first supply route of pressurized fluid supplying makeup fluid to the cam torque actuated advance chamber and the cam torque actuated retard chamber; and a second supply route of pressurized fluid supplying fluid to the oil pressure actuated retard chamber;

wherein when the phaser is in an advance position, wherein fluid is routed from the cam torque actuated retard chamber to the cam torque actuated advance chamber and the bias spring in oil pressure actuated advance chamber is compressed;

wherein when the phaser is in a retard position, wherein fluid is routed from the cam torque actuated advance chamber to the cam torque actuated retard chamber and fluid is routed to the oil pressure actuated retard chamber from the second supply route and the bias spring in the oil pressure actuated advance chamber is extended.

28. The variable camshaft timing phaser of claim 27, further comprising:

a locking pin controlled by fluid from the second supply route, slidably located in a radial bore, comprising a body having a diameter adapted to a fluid-tight fit in the radial bore, and an inner end toward the housing or the rotor adapted to fit in a receiving hole defined by the housing or the rotor, the locking pin being radially movable in the bore from a locked position in which the inner end fits into the receiving hole defined by the housing or the rotor, to an unlocked position in which the inner end does not engage the receiving hole defined by the housing or the rotor.

29. The variable camshaft timing phaser of claim 28, wherein the locking pin is in the locked position when the phaser is in the advance position and the locking pin is in the unlocked position when the phaser is in the retard position.

30. The variable camshaft timing phaser of claim 27, further comprising a check valve in the first supply route.

31. The variable camshaft timing phaser of claim 27, wherein when the phaser is in the retard position, fluid exhausts from the oil pressure actuated advance chamber through the exhaust line.

32. The variable camshaft timing phaser of claim 27, further comprising a variable force solenoid received by the first end of the sleeve for biasing the spool against the spring.

* * * * *

UNITED STATES PATENT AND TRADEMARK OFFICE

CERTIFICATE OF CORRECTION

PATENT NO. : 7,255,077 B2
APPLICATION NO. : 11/286483
DATED : August 14, 2007
INVENTOR(S) : Simpson et al.

It is certified that error appears in the above-identified patent and that said Letters Patent is hereby corrected as shown below:

Column 4, line 23: Delete the word “advance” and add the word --retard--.

Column 4, line 23: Delete the word “retard” and add the word --advance--.

Signed and Sealed this

Twenty-fourth Day of June, 2008

JON W. DUDAS
*Director of the United States Patent and Trademark Office*